US008363865B1

(12) United States Patent
Bottum

(10) Patent No.: US 8,363,865 B1
(45) Date of Patent: Jan. 29, 2013

(54) MULTIPLE CHANNEL SOUND SYSTEM USING MULTI-SPEAKER ARRAYS

(76) Inventor: Heather Bottum, Fairview Park, OH (US)

( * ) Notice: Subject to any disclaimer, the term of this patent is extended or adjusted under 35 U.S.C. 154(b) by 693 days.

(21) Appl. No.: 12/434,740

(22) Filed: May 4, 2009

Related U.S. Application Data

(63) Continuation-in-part of application No. 10/851,739, filed on May 24, 2004, now abandoned.

(51) Int. Cl.
*H04R 5/02* (2006.01)

(52) U.S. Cl. ..... 381/307; 381/300

(58) Field of Classification Search ..... 381/303–307, 381/310, 300, 333–336
See application file for complete search history.

(56) References Cited

U.S. PATENT DOCUMENTS 5,199,075 A * 3/1993 Fosgate ..... 381/307
5,502,772 A 3/1996 Felder
5,666,422 A 9/1997 Harrison et al.
5,870,484 A * 2/1999 Greenberger ..... 381/300
5,953,432 A * 9/1999 Yanagawa et al. ..... 381/335
6,122,381 A 9/2000 Winterer
6,292,570 B1 9/2001 Aarts
6,385,320 B1 5/2002 Lee
6,577,738 B2 6/2003 Norris et al.
6,597,791 B1 7/2003 Klayman
2002/0048381 A1 * 4/2002 Tamayama ..... 381/307
2003/0068051 A1 * 4/2003 Bottum ..... 381/99
2006/0204022 A1 * 9/2006 Hooley et al. ..... 381/117

* cited by examiner

*Primary Examiner* — Hai Phan
(74) *Attorney, Agent, or Firm* — Patent, Copyright & Trademark Law Group, LLC; John D. Gugliotta, P.E., Esq.; Howard L. Wernow

(57) ABSTRACT

An apparatus that provides for the reproduction of 6.1 surround sound (or other formats of) audio programs using a minimum of two speaker cluster locations is disclosed. The current invention accurately produces surround sound effects with speakers in only two locations in lieu of the conventional six. A sub-woofer, in its normal configuration, can be used with the invention if desired. The left front, rear center, rear left and center signals are produced from a left cluster array. The right front, rear center, rear right and center signals are produced from a right cluster array. This configuration eliminates the need for a center speaker and for rear speakers. Such elimination of speaker locations, along with their associated wiring, produces a less cluttered look, and lends itself to use in listening rooms of smaller size.

29 Claims, 13 Drawing Sheets

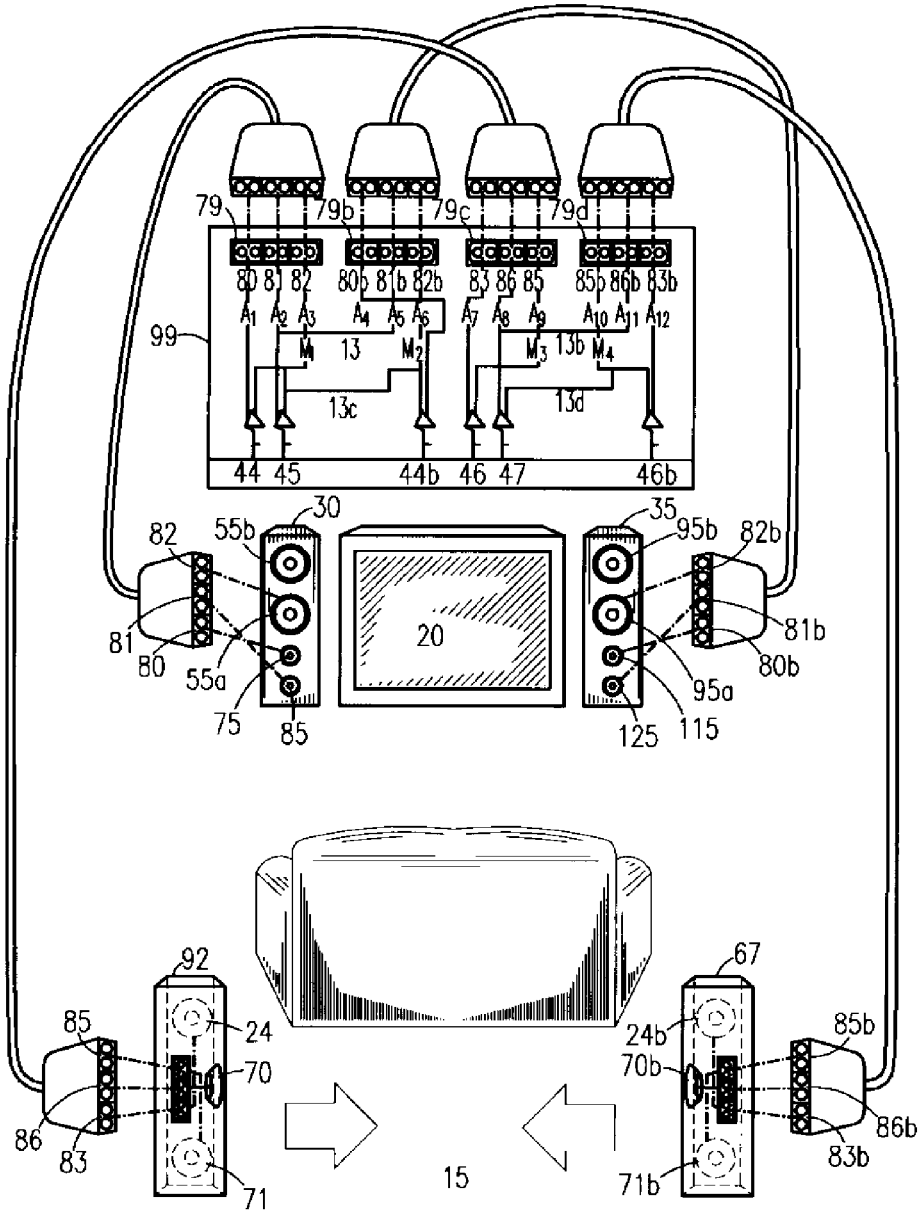
*Fig. 6a1*

15

MULTIPLE CHANNEL SOUND SYSTEM USING MULTI-SPEAKER ARRAYS

RELATED APPLICATIONS

The present invention is a Continuation in Part of Ser. No. 10/851,739, filed on May 24, 2004 now abandoned.

BACKGROUND OF THE INVENTION

1. Field of the Invention

The present invention relates generally to home theater sound systems, and, more particularly, to a multi-channel/signal sound cluster adapted for use as in-wall or outer wall units.

2. Description of the Related Art

Home theater entertainment systems are becoming increasingly sophisticated and complex. An important part of achieving the best performance of these systems is the multiple speakers they require. Typically in a 6.1 surround sound system, there are 7 speakers as follows: a front center speaker, a right front speaker, a left front speaker, a right rear speaker, a left rear speaker, a center rear speaker and a sub-woofer. While the sound from such a system is undoubtedly realistic, the impact on the room decor from the multiple speakers and possibly exposed wiring is often less than welcome. Additionally, next generation surround formats have traditionally offered upgrades by simply adding more discrete speakers.

Accordingly, there is a need for a surround sound system that addresses these needs and shortcomings of existing surround sound speaker installations. Particularly, the present invention improves existing 6.1 seven speaker surround formats and the like without requiring seven visible speakers, and in other circumstances additional speakers. For example, a seven speaker room arrangement in order to provide 6.1 surround sound format can generate more than one channel or signal of sound at one location. Existing seven speakers in a 6.1 surround sound format can perform, for example, 18 channels or signals of sound through what visibly appears to be six speakers or speaker cluster cosmetics. Additionally, 6.1 sound is able to be achieved through two arrays along with a subwoofer. The subwoofer can be configured to receive and perform 2 or more channels or signals of sound, 1 signal being for higher than bass frequencies. While on location, sound could be generated at one multi-channel/signal cluster array location, other sound channels or signals could be generated at the same location (enclosure or cluster) for additional effects, for effects utilized with imaging or similar type effects, for matrixing, and the like.

A search of the prior art did not disclose any patents that read directly on the claims of the instant invention; however, the following references were considered related:

| U.S. Pat. No. | Inventor | Issue Date |
|---|---|---|
| 6,385,320 81 | Lee | May 7, 2002 |
| 6,597,791 81 | Klayman | Jul. 22, 2003 |
| 6,577,738 82 | Norris et al. | Jun. 10, 2003 |
| 5,666,422 | Harrison et al. | Sep. 9, 1997 |
| 6,292,570 81 | A arts | Sep. 18, 2001 |
| 6,122,381 | Winterer | Sep. 19, 2000 |

Additional references considered related:

Web site publication, NIROSONTMCinema Technology, NIRO TW06.1 Home Theater System, '03;

"It Takes Two", ROBB REPORT, February '03;

"Niroson TW06.1 Two-box surround sound", Hi-FiNews, January. '03; and

VENTRILOQUIST™ surround sound system which utilizes a center channel speaker having 3 channel inputs. Speakers are wired for other sections in the room. VENTRILOQUIST™ operates as a passive woofer for higher than sub frequencies. Dual voice coils are built into the center speaker to produce low midrange bass for 2 additional speaker channels. The remaining channel/signal frequencies above 100 Hz for the 2 additional channels are generated at other locations in the room with small speakers placed randomly thereabout. However, VENTRILOQUIST™ is not intended for high frequency sound for more than one channel or signal, and thus is not a multi-channel/signal speaker system. Ventriloquist places satellite (mini-speakers) where on-location sound is to be generated in a 5.1, 6.1 and 7.1 systems. VENTRILOQUIST™ utilizes the larger standard center channel to generate the mid-bass generally missing with satellite systems for the left and right front channels. VENTRILOQUIST™ is not a multi-channel/multi-signal array thereby placing left and right mini-speakers at the left and right front of the listening area where the on-location sound should be, as specified by Dolby™ surround formats. The smaller satellite speakers are wired or connected to the front center speaker so that mini-speakers of left and right front can be placed in a room format in accuracy with Dolby™ 5.1, 6.1 or 7.1 five, six, or seven speaker formats at left and right of the listening area.

SUMMARY OF THE INVENTION

Therefore, it is an object of the present invention to provide a multi-channel/signal array adapted to produce sound imaging effects producing sound which appears to emanate from locations other than the sound's source.

It is another object of the present invention to provide a surround sound system adapted to generate sound at one multi-channel/signal cluster array location, while other sound channels or signals could be generated at the same location (enclosure or cluster) for additional effects, for effects utilized with imaging or similar type effects, for matrixing, and the like.

It is further object of the present invention to provide such imaging or similar type affects in a manner that could eliminate the use of rear arrays by using the front clusters to produce effects for the rear channels and disregard the rear array(s).

It is another object of the present invention to provide a left front speaker cluster positioned left of a television monitor.

It is another object of the present invention to provide a right front speaker cluster positioned right of the television monitor.

It is another object of the present invention to provide a rear speaker cluster or clusters located directly behind a listening position.

It is another object of the present invention to provide subwoofers that may be adapted to receive and perform at least three channels or signals of sound, one signal being for higher than bass frequencies.

It is another object of the present invention to provide a left duster enclosure which houses one multiple channel or signal mid-bass woofer.

It is another object of the present invention to provide quick-connect plug-in terminals adapted to connect the left front speaker cluster, the right front speaker cluster, the rear speaker cluster or clusters and the subwoofer(s) to a receiver unit or a speaker driver component.

Briefly described according to one embodiment of the present invention, a multi-channel/signal array is provided. The invention provides for the reproduction of 6.1 or other formats of surround sound audio programs using a minimum of two cluster locations. The current invention accurately produces surround sound effects with cluster arrays in only two locations in lieu of the conventional formats (six for 6.1). A subwoofer, in its normal configuration, can be used with the invention if desired, and in other cases, could be a part of cluster arrays. The left front, front center, rear center, and left rear signals are produced from a left cluster array. The right front, front center, rear center and right rear signals are produced from a right cluster array. This configuration eliminates the need for a center speaker, which is typically difficult to place directly above or below a conventional television, and even more difficult to locate when using a flat panel or plasma display. It also eliminates the need for rear speakers. Elimination of speaker locations, along with their associated wiring, produces a less cluttered look, and lends itself to use in listening rooms of smaller size.

More particularly, the multi-channel/signal array defines a left front speaker cluster positioned left of a television monitor and a right front speaker cluster positioned right of the television monitor. The left front cluster and the right front cluster, are provided with at least two discrete audio signals or channels via a receiver unit or like device.

Quick-connect plug-in terminals can be adapted to connect the left front speaker cluster array and the right front speaker cluster array to receiver unit or devices in applicable configurations.

A front center signal, a rear center signal, a left main signal, and a left rear signal is transmitted and accepted by the left front speaker cluster array. A front center signal, a rear center signal, a right main signal, and a right rear signal is transmitted and accepted by the right front speaker cluster array. Sound, imaging, or similar type effects are adapted to produce sound which appears to emanate from a location other than the sound's source.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

FIG. 6A and FIG. 6A1 are a 6.1 configuration with rear center speaker effect drivers located in both clusters 92 and 67.

FIG. 6B is a 6.1 configuration version of FIG. 1A with the addition of two mid-high drivers for left and right back, two mid-high drivers for the rear center channel and, two additional active mid-bass woofers for right and left main channels. Signals are sent to the speaker components via amplification versus decoding inside the speakers with multiple voice coils and crossovers. The sonic outcome is the same as FIG. 1A.

FIG. 6C is a 6.1 configuration showing matrixing between clusters from the clusters themselves, in order to create additional channels or signals between the clusters.

DESCRIPTION FO THE PREFERRED EMBODIMENTS

The best mode for carrying out the invention is presented in terms of its preferred embodiment, herein depicted within the FIGS. 1*a* through 5 can shown in numerous ways as useful in the art. Consequently, FIG. 1*a*-6*e* will be described as Dolby™ formats currently limiting the number of channels provided.

1. Detailed Description of the Figures

Figure 1A:
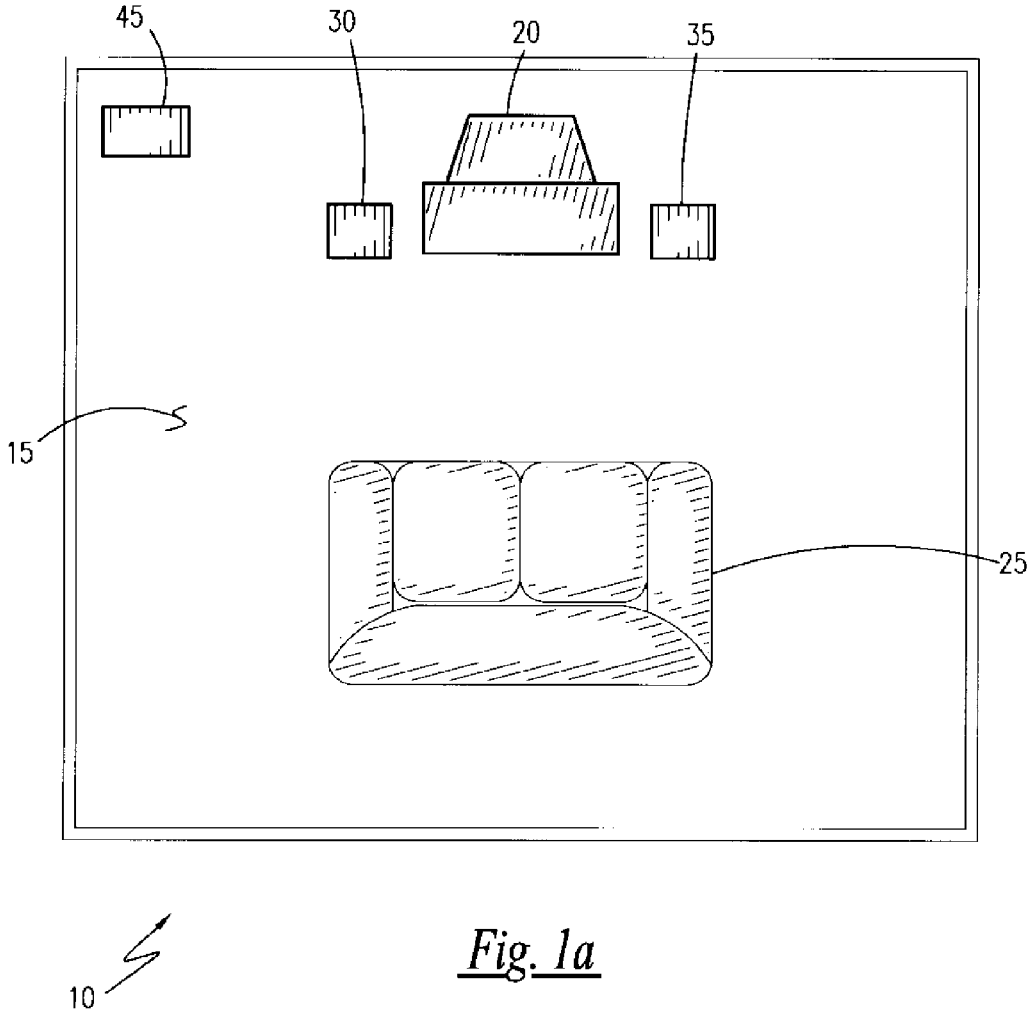
FIG. 1*a* is a plan view of a room using the multi-channel/signal array sound system 10, according to a preferred embodiment of the present invention.

Referring to FIG. 1*a*, a plan view of a room using the multi-channel/signal array 10, according to a preferred embodiment of the present invention is disclosed. A home theater room 15, such as what might be used for watching and listening to high-definition television (HDTV), digital versatile discs (DVD) encoded with surround sound information, compact discs (CD's), or the like is provided. A television monitor 20 is arranged in a symmetrical position with a listening position 25 directly opposite of it as would be expected. On the left and the right of the television monitor 20 is a left front array 30 and a right front cluster array 35 respectively. A subwoofer 45 may be provided independently in a customary location, and alternately inside left front cluster array 30 and/or right front cluster array 35, although the satisfactory operation of the multi-channel/signal array 10 does not depend on the use of the subwoofer 45. The signals provided to the left front cluster array 30, the right front cluster array 35, and the subwoofer 45 can be produced by common 6.1 surround sound amplifiers, audio sources, receivers or the like being well-known in the art and adapted for receiving signals and transmitting such signals to cluster arrays 30, and subwoofer 45. Speaker driver components receiving signals from, including but not limited to surround sound amplifiers and receivers, are connected to the present invention via quick-connect plug-in terminals. And while the preferred embodiment considers industry standard positive and negative wire terminals, couplers and other electronic component connection variants including wireless transmission, obvious dimensional as well as functionally adaptable modifications which allow the present invention's principles to apply to unpublished current driver components and future industry standards are also considered within invention's scope. The subwoofer signal would go to the subwoofer 45, the front center, rear center, left rear, and left main signals would go to the left front cluster array 30, the front center, rear center, right rear, and right main signals would go to the right front cluster array 35. Sound, imaging or similar effects, effects facilitating directionality of drivers, and other effects will make sound seem to appear as if it is being generated at times in places other than the cluster arrays, such as outside, above or below such cluster arrays.

The conventional method of producing a center sound signal is accomplished utilizing a separate center speaker which is placed in a room between a right and left speaker enclosure. In contrast, the effect produced by the multi-channel/signal array 10 operates to send the center signal to both the left front cluster array 30 and the right front cluster array 35, as the cluster phenomenon employed by said clusters allows this. The cluster phenomenon will be described in greater detail herein below. The monaural signal required by the center channel forced a single based speaker enclosure, which is not always possible, or readily available, or aesthetically desirable. Should a monaural sound source be used with the multi-channel/signal array 10, a center channel using both the left front cluster array 30 and the right front cluster array 35 is readily available and can be used to produce sound effects for the center channel by distributing the monaural signal across a wider plane of listening field when listened to from the listening position 25. Often, in this instance, drivers in cluster array 30 and cluster array 35 which are utilized for center channel sound reproduction, will be aimed in mirror image towards a television (typically at 30 degrees in a center of each cluster) thereby generating sound which appears to emanate from center of cluster array 30 and cluster array 35. It is envisioned that two or more discrete or nondiscrete signals or channels would be available in order to produce more than one sound effect for the center channel, or other channel, and with additional benefits which include but are not limited to imaging and similar effects which are adapted to produce sound which appears to emanate from locations in the room other than its true source, for example, with regard to the instant invention, between cluster array 30 and cluster array 35. It should be noted that while just two cluster locations are shown in FIG. 1*a*, other speaker clusters can be used and located throughout the home theater room 15 to even greater enhance the listening field. As such the quantity of speaker clusters, each fed with multiple signals, should not be interpreted as a limiting factor of the present invention.

Figure 1B:
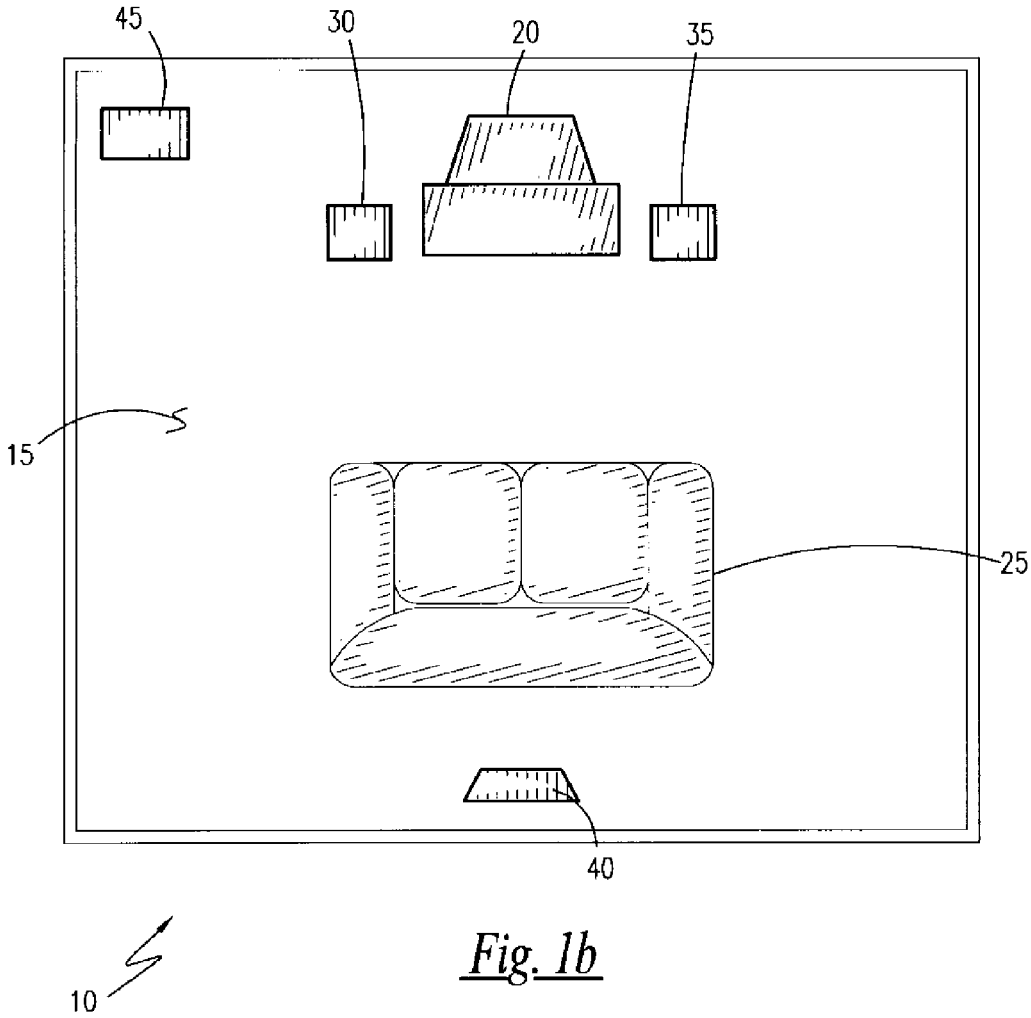
FIG. 1*b* is a plan view of a room using the multi-channel/signal array sound system 10 illustrating the addition of a rear multi-channel signal array 40.
Figure 1C:
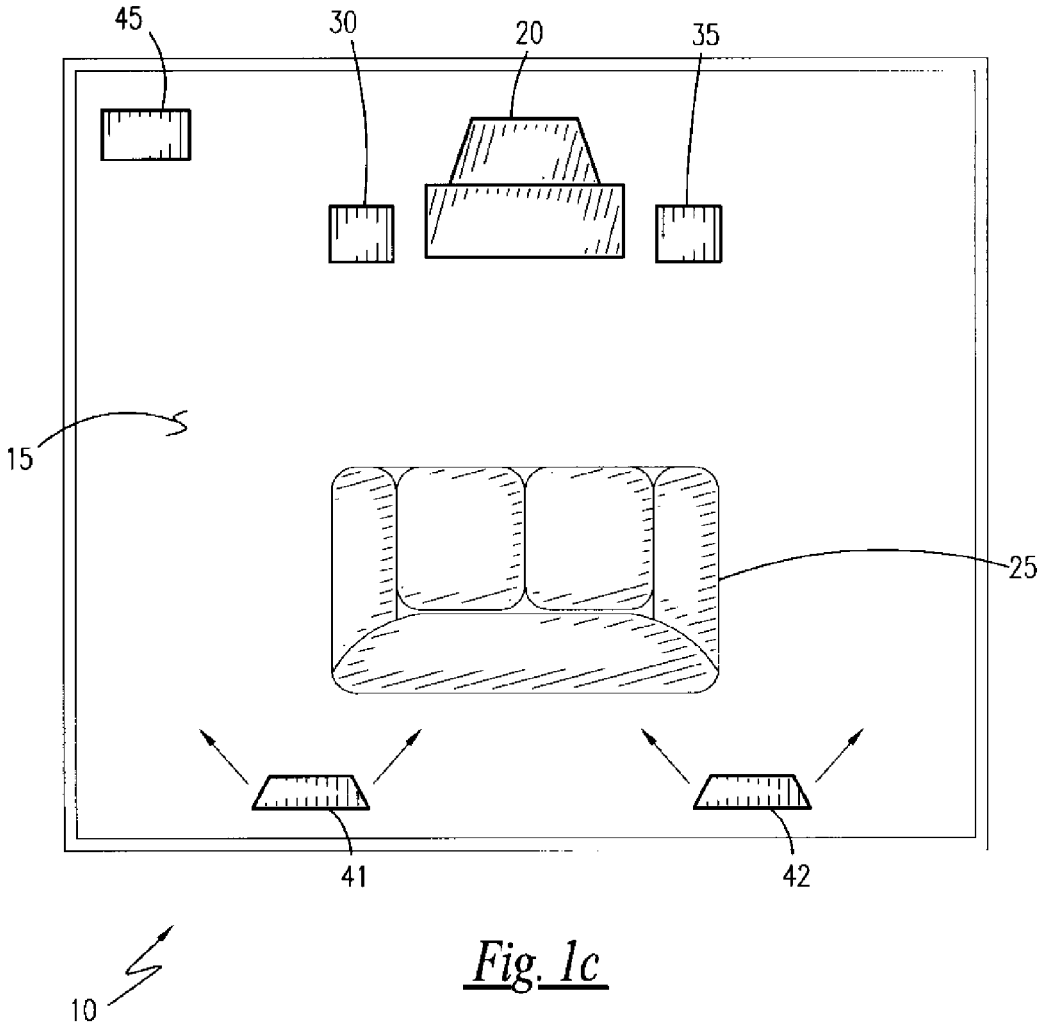
FIG. 1*c* is a plan view of a room utilizing the multi-channel/multi-signal arrays in system 10 illustrating two rear arrays 41, 42 in a 7.1 application.

Now referring to FIG. 1*c* in view of a 7.1 configuration. Two rear cluster arrays are present. In FIG. 1*c* the left back and left surround channels of a 7.1 system are generated in array 41. The right surround and right surround back channels are generated at multi-channel/signal array 42. The left front and front center channel signals are generated by left cluster 30 and the right front and front center is generated by cluster multi-channel/multi-signal array 35.

Figure 2:
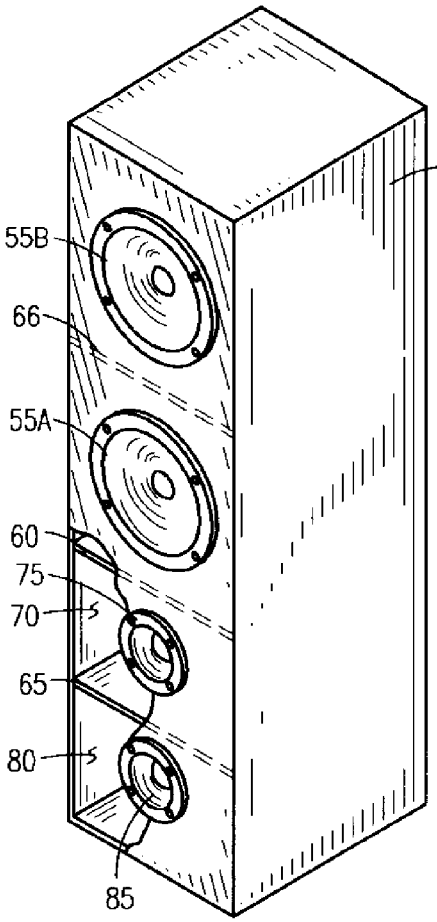
FIG. 2 is a partial cutaway view of a left front cluster array 30 as used with the multi-channel/signal array 10.

Referring next to FIG. 2, a partial cutaway view of the left front speaker cluster 30 as used with the multi-channel/signal array 10 is depicted for FIG. 1*a*. The main component of the left front cluster array 30 is a left cluster enclosure 50. The left cluster enclosure 50 can be made from wood, wood products, plastic, or other materials typically found in a conventional speaker enclosure. A front grille can be provided as well, but is shown removed for purposes of clarity. Speaker driver components and speaker component placement and directionality in cluster array 30 will vary based upon design, price, size, etc.

Referring to FIG. 2 and according to FIG. 1*a*, the upper portion of the left cluster enclosure 50 houses two first mid-bass woofers (55*a* and 55*b*). While a first mid-bass woofer 55*a* utilizes a dual voice coil for two channel mid-bass reproduction in order to provide two channel mid-bass performance via reduced dimensions (in this case for the front center and left main channels), a second mid-bass woofer 55*b* utilizes a dual voice coil for the center rear and left surround channels. In other instances dual voice coil(s) may not be present.

The left cluster enclosure 50 can be divided into four separate acoustic enclosures by the use of a first enclosure divider 60, a second enclosure divider 65 and another divider 66. A first middle internal chamber 70, bordered by the first enclosure divider 60 and the first enclosure divider 65, is an internal chamber for a first mid/high driver 75, envisioned to be a 2½" driver with a swivel tweeter in the center, though not to be interpreted as a limiting factor of the present invention. The first middle internal chamber 70 forms a separate mid-high speaker enclosure for the left main channel, though an integral part of the left cluster_enclosure 50 (mid-high chamber enclosures should not be a limiting factor to the design as they are not always necessary). The mid-bass frequencies for the center channel signal would also be mirrored in cluster 35 by mid-bass woofer 95*a*. As such, the first mid/high driver 75 is adapted to receive and perform mid-high frequencies for the left main front channel. Alternately, dual voice coils may be present for two channel mid-high reproduction. A lower internal chamber 80, located at the bottom of the left cluster enclosure 50 and contained by the first enclosure divider 65 is an internal chamber for a second mid/high driver 85, also envisioned to be a 2½" driver with a swivel tweeter in the center, though not to be interpreted as a limiting factor of the present invention. The lower internal chamber 80 forms a separate mid-high speaker enclosure for the center channel, though an integral part of the left cluster enclosure 50 note: a chamber may not always be necessary for the design. As such the second mid/high driver 85 is adapted to receive mid-high frequencies for the center front channel. The second mid/high driver 85 would be mirrored in the right front speaker cluster 35, and fed an identical electrical signal, thus producing center channel speaker mid/high sound even while being located on opposite sides of the television monitor 20 (as shown in FIGS. 1*a* and 6*b*). Mid-bass center channel sound would be performed by woofer 55*a* and also mirrored in the right cluster array 35 by 95*a*. This center channel speaker sound typically produces all or most of the voices during movies or similar programming. Placement at the center, or external of the television, along opposed ends thereof (as shown in FIGS. 1*a* and 1*b*) will cause the voices to sound like they are coming from the source where people are talking. Such configuration of the multi-channel/signal array 10 further allows for drivers such as these to be mounted in a manner in the middle of arrays 30 and 35 directing center channel speaker sound into an area central of a conventional or common television screen, thus producing voices which appear to emanate from a middle portion of the television screen. The center speaker placement above or below a conventional television is difficult for practical and cosmetic reasons with special regard to plasma or thin televisions. The multi-channel/signal array 10 provides an enclosure being capable of producing two or more signals from a single enclosure or cluster cosmetics.

As shown in FIG. 1*b*, only the left front and the front center channel is generated by left front duster 30. The right front channel and mirrored front center channel, are generated by cluster 35. In FIG. 1B, mid-bass woofers 55*b* performs with 55*a* as a passive radiator or, it could be a dual voice coil in parallel or series with 55*a*, for dual active woofer output for the front left channel and the center channel. In this case, divider 66 may not be necessary (alternatively, 55*b* could not be present at all). Similar to 55*a* and 55*b*, mid-bass woofer 95*b* would perform with 95*a* for the front center and right main channels. 95*b* would act as a could act as a passive radiator, be in parallel or series with 95*a* or could be not be present at all. Divider 67 should not be a limiting factor to the design as it will not always be necessary.

Figure 3:
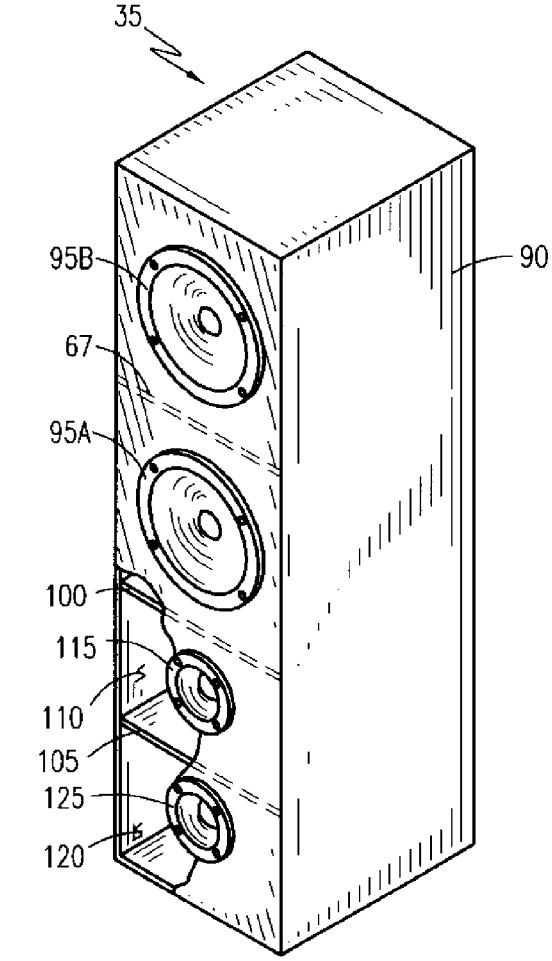
FIG. 3 is a partial cutaway view of a right front cluster array 35 as used with the multi-channel/signal array 10.

In the rear, rear multi-channel/signal array 40 (shown in FIG. 1*b*) generates left rear signals, center rear signals, and right rear signals. Referring to FIG. 1C, the rear multi-channel arrays 41 and 42 generate the left back, left surround back and right back and right surround back channel signals for a 7.1 system. While not shown in FIGS. 1*a* through 1*c*, other separate, but integral enclosures could be added or rearranged for other channels or signals. Additionally, the first mid/high driver 75 and the second mid/high driver 85 could employ the use of dual or triple voice coils. It should be noted that while FIG. 2, shows the left front cluster array 30 in a vertical position, a horizontal position can also be used with equally good results. Referring now to FIG. 3, a partial cutaway view of the right front cluster 35 array as used with the multi-channel/signal array 10 is disclosed in FIG. 1*b*. The main component of the right front cluster array 35 is a right cluster enclosure 90. The right cluster enclosure 90, similar in nature to the left cluster enclosure 50 (as shown in_FIG. 2) can be made from wood, wood products, plastic, or other components typically found in a conventional speaker enclosure. A front grille can be provided as well, but is shown removed for purposes of clarity. Speaker components and speaker component placement and directionality in right front cluster array 35 will vary based on design, price, size, etc. As shown in FIG. 3 for use in FIG. 1*b*, the upper portion of the right cluster enclosure 90 houses one second dual voice coil mid-bass woofer with another woofer driver 95*b* utilized as a passive radiator. Alternatively, dual voice coils and/or mid-bass woofers may not be present, in other cases, more than one active mid-bass woofer may be utilized. The right cluster enclosure 90 is divided into three separate acoustic enclosures by the use of a third enclosure divider 100 and a fourth enclosure divider 105. A second middle internal chamber 110, bordered by the third enclosure divider 100 and the fourth enclosure divider 105, is an internal chamber for a third mid/high driver 115, envisioned to be a 2½" driver with a swivel tweeter in the center, though not to be interpreted as a limiting factor of the present invention. The second middle internal chamber 110 forms a separate mid-high speaker enclosure for the right main channel, though an integral part of the right cluster enclosure 90. A chamber may not always be necessary. As such, the third mid/high driver 115 is adapted to receive and perform mid-high frequencies for the right main front channel, while mid-bass is received and performed by second mid-bass dual voice coil woofer 95*a*. A second lower internal chamber 120, located at the bottom of the right cluster enclosure 90 and contained by the fourth enclosure divider 105 is an internal chamber for a fourth mid/high driver 125, also envisioned to be a 2½" driver with a swivel tweeter in the center, though not to be interpreted as a limiting factor of the present invention. Chambers are not always required for mid-high drivers and all chambers also may be eliminated for in-wall speaker designs. The second lower internal chamber 120 forms a separate mid-high speaker enclosure for the center channel, though an integral part of the right cluster enclosure 90. As such the fourth mid/high driver 125 is adapted to receive and perform mid-high frequencies for the center front channel. The fourth mid/high driver 125 is mirrored by the second mid/high driver 85 in the left front cluster array 30 (as shown in FIG. 2), and fed an identical signal, thus producing an apparent center channel even while being located on opposite sides of the television monitor 20 (as shown in FIG. 1*a*-6*b*). The fourth mid/high driver 125 and the second mid/high driver 85 (and/or alternatively mid-bass woofers) are often angled at thirty degrees towards the television screen, and are often positioned in an area probable for directing driver's 125 and 85 sound into a center of the television screen. Typically, such placement is central of left front cluster array 30 and right front cluster array 35 as illustrated by the taller vertical design formats in FIGS. 1*a* and 1*b*. The left rear signals, center rear signals, and right rear signals are received and performed by cluster array 30 and 35, as illustrated in FIG. 1*a*, while the left rear signals, center rear signals, and right rear signals are received and performed by rear multi-channel/signal array 40, as illustrated in FIG. 1*b*. Referring to FIG. 1C, the left back and left surround channel signals of the 7.1 system a generated by array 41 and the right surround and right surround back signals are generated by cluster array 42. While not shown in FIG. 1*a* or 1*b*, other separate, but integral enclosures could be added or rearranged for other channels or signals. Additionally, the second mid-bass woofer driver 95, the third mid/high driver 115 and the fourth mid/high driver 125 could employ the use of dual or triple voice coils. It should be noted that while FIG. 3, shows the right front cluster array 35 in a vertical position, a horizontal position can also be used with equally good results.

Figure 4A:
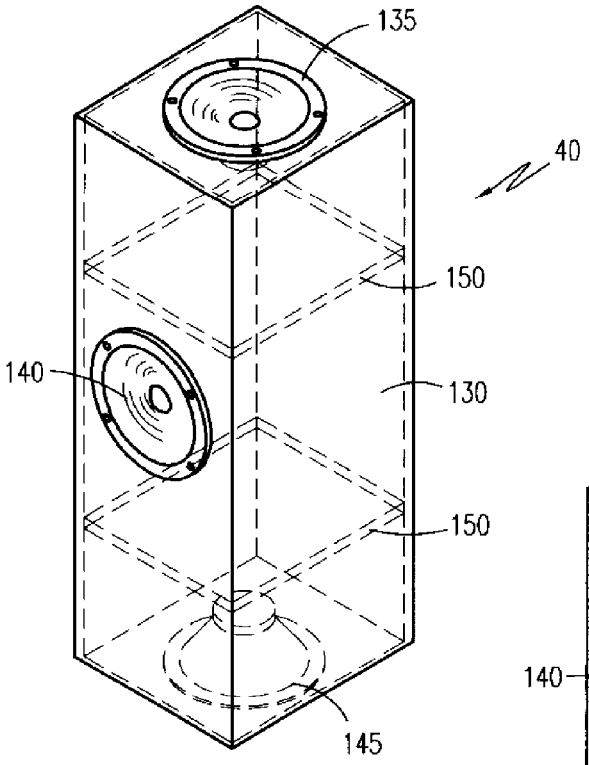
FIG. 4*a* is a front view of a rear speaker cluster 40 as used with the multi-channel/signal array 10 according to FIG. 1*b;*

Referring finally to FIG. 4*a*, a front view of the rear multi-channel/signal array 40 as used with the multi-channel/signal array 10 in FIG. 1*b* is shown. The rear multi-channel/signal array 40 is comprised of a rear cluster enclosure 130. As with left front speaker cluster 30 and right front speaker cluster 35, outer enclosures of rear cluster enclosure 130 may appear to have a cluster of speaker cosmetics in particular designs. The rear cluster enclosure 130, similar in nature to the left cluster enclosure 50 (as shown in FIG. 2) or the right cluster enclosure 90 (as shown in FIG. 3) can be made from wood, wood products, plastic, or other components typically found in a conventional speaker enclosure. The rear cluster enclosure 130 contains three separate sound signal producing devices, although not intended to be a limiting factor, which include: 2.5 inch right mid-high driver 135, a center rear 2.5 inch mid-high driver 140, and a rear 2.5 inch left mid-high driver 145. The rear right mid-high driver 135 produces sounds associated with the right rear channel, the rear center mid-high driver 140 produces sounds associated with the rear center channel, and the rear left mid-high driver 145 produces sounds associated with the left rear channel. The rear Center driver 140 is forward directed to take advantage of the ability to direct sound directly at the listening position 25 (as shown in FIG. 1*b*). Although not shown in FIG. 4*a*, the rear center mid-high driver(s) 140 may be angularly positioned and/or at other locations, and could also be used in combination with other drivers, woofers, or additional effects. The rear right mid-high driver 135 and the rear left mid-high driver 145 are side-firing positioned, thus directing their more directional frequency sound waves to opposite walls to produce a sound effect for each channel (signal) which appears to emanate from opposite sides of the home theater room 15 (as shown in FIG. 1*b*), though not intended to be a limiting factor with respect to directionality based upon woofer size and the like.

A series of internal dividers 150 (shown using phantom lines for purposes of illustration) divide the internal dividers 150 into three separate, but integral, enclosures. Such a configuration forms a multi-channel/signal cluster array, similar in nature to its counterpart, the left front cluster array 30 (shown in FIG. 2) and the right front cluster array 35 (shown in FIG. 3). These multi-channel/signal cluster arrays produce a multi-channel/signal array adapted to deliver sound for more than one speaker channel or speaker signal with the cosmetic appearance of less speaker enclosures, while sounding like independent speakers located at discrete points. While each of the drivers used with the rear multi-channel/signal array 40 are shown as single component and single coil drivers, multiple drivers or the use of dual or triple voice coils could also be used and as such, should not be interpreted as a limiting factor of the present invention.

Figure 4B:
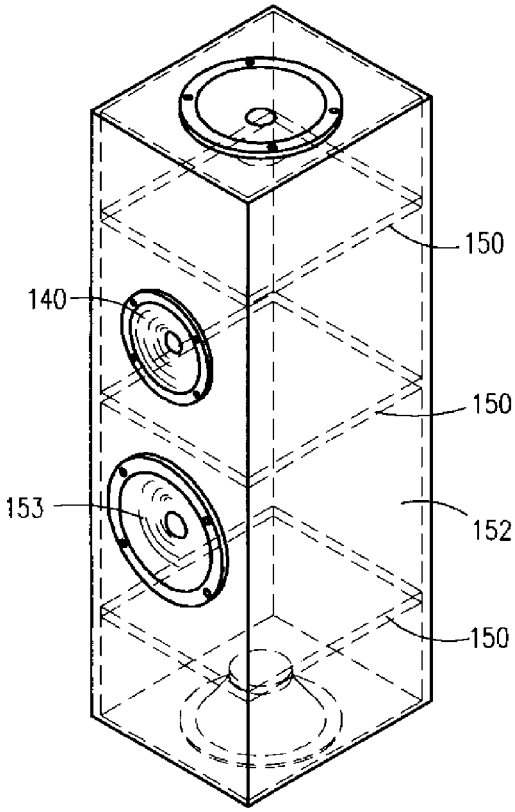
FIG. 4*b* is a front view of a rear speaker cluster 40 shown incorporated with an additional internal chamber 152 housing a mid-bass woofer 153.

However, while the use of midrange (mid-bass) woofer(s) is not shown in FIG. 4*a*, typically, such woofers may be included and utilized with triple voice coils to generate midrange sound frequencies for all three channels or signals (particularly in this instance left, right, and rear center channels) in order to reserve in size of the enclosure for purposes of providing additional internal chambers 152 for housing mid-bass woofer 153, as shown in FIG. 4*b* (chamber may not always be necessary especially with regard to in wall designs).

Figure 4C:
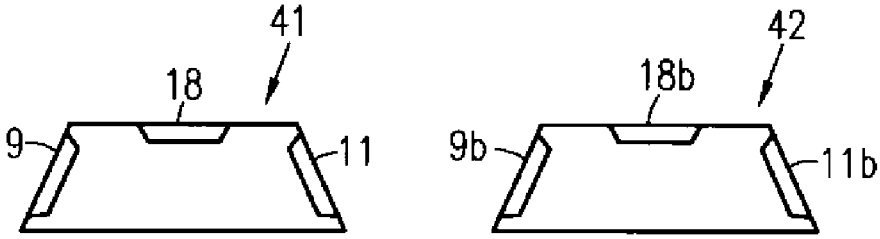
FIG. 4*c* is a top view of rear array clusters 41 and 42 as used with the multi-channel/multi-signal array plan 10 according to 1*c;*

Referring now to FIG. 4C a top view of the rear multi-channel arrays 41 and 42 as used with multi-channel array 10 is shown. Enclosures 41 and 42 can be made from wood, plastic, or other components typically found in a conventional speaker enclosure. Placed in the back or on the sides of a 7.1 system rear clusters 41 and 42 produce 2 channel signals though not to be a limiting factor. As shown in FIG. 4C, 2.5" mid-high driver 11 is angled producing more directional frequencies of the left surround back channel of the 7.1 system. Mid-high driver 9 is angled generating mid-high directional frequencies of the left surround 7.1 channel. The right mid-high driver 11*b* is angled generating directional higher frequencies of the right surround and right surround back channel mid-high driver 9*b* is angled generating more directional frequencies of the right surround back channel. Referring to mid-bass woofers 18 and 18*b*, both 18 and 18*b* mid-bass woofers employ a dual voice coil for two channel mid-bass reproduction via reduced dimensions of multi-channel/signal arrays. This is not to be a limiting factor of components.

It is envisioned that other styles and configurations of the present invention can be easily incorporated into the teachings of the present invention and only two configurations shall be shown and described for purposes of clarity and disclosure and not by way of limitation of scope.

Figure 4D:
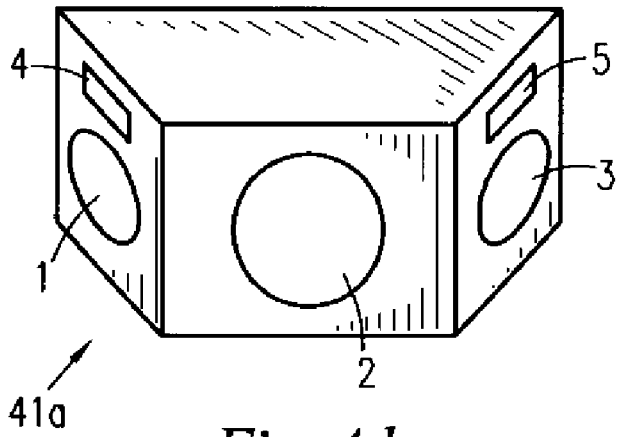
FIG. 4*d* is a top view of speaker clusters 41*a* as used in FIG. 1*c* if substituted for multi-channel/signal array 41.
Figure 5:
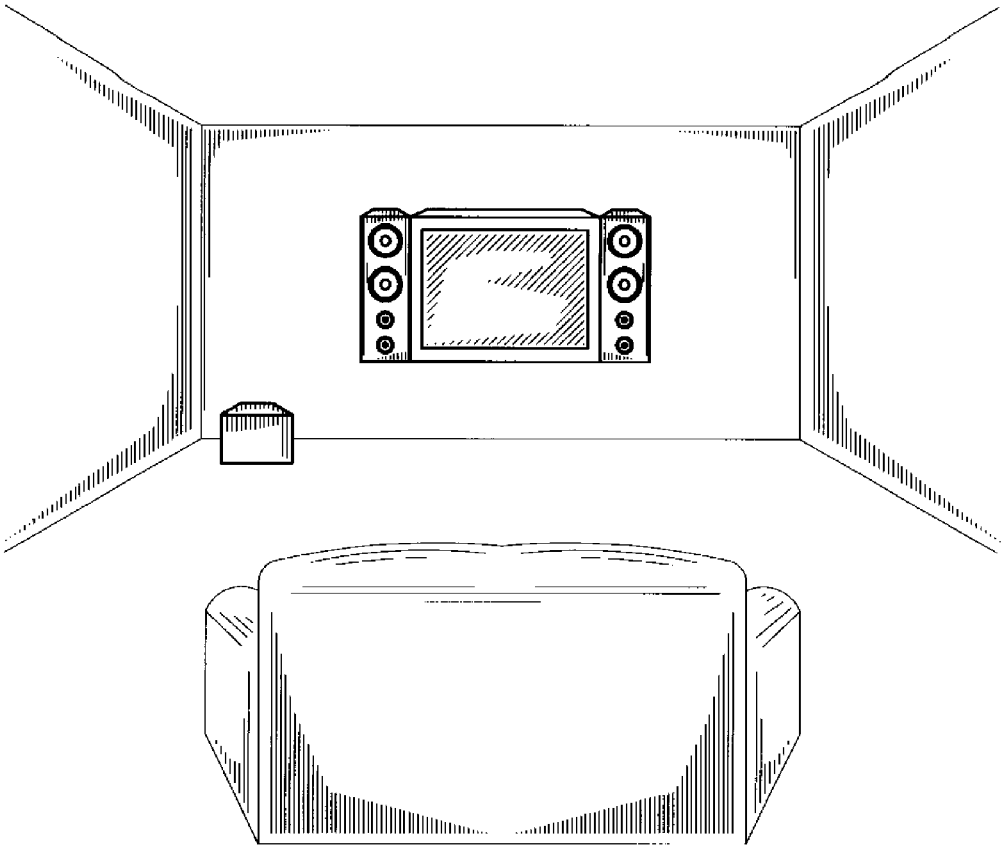
FIG. 5 is a front view of the multi-channel/signal array sound system of FIG. 1A shown without the rear speaker cluster 40.

Referring now to FIG. 4D, a front view of another version of arrays 41 is depicted called 41*a*. For simplicity matching cluster 42*a* is not shown. Enclosures 41*a* can be made from wood, plastic, or other components typically found in a conventional speaker enclosure. Placed along the left back or on the left side of a 7.1 system rear cluster 41*a* produces 2 channel signals for the left back and left surround channels of the 7.1 system (though not limiting to channel use). As shown in FIG. 4D one coil of dual voice coil woofer or driver 2, on multi-channel signal array 41*a* is utilized to receive and perform any portion of channel or signal I am calling A or left surround back of a 7.1 system. A sends any portion of signal A to left side woofer 1 generally by parallel or series (placement of woofers, midranges tweeters or signals should not be a limiting factor). Woofer or driver size vanes tweeters can be present. The second coil (or the like) of dual voice coil woofer or driver 2 is utilized to receive and perform any portion of channel or signal I am calling B or left surround channel of the 7.1 system. Any portion of signal B is sent generally by paralleling (or series) to right side woofer or driver 3 for left surround channel performance. Woofers or drivers 1, and 3 are angularly positioned along with possible tweeters or horns 4 and 5 for 7.1 placement in the back of the listening area or along the side walls, not to be a limiting factor of placement of speaker components. The result achieved is a matrixed signal of the left back channel and the left surround back channel at woofer 2 creating another channel or signal in the array between mid-bass woofer or mid-driver 1 and mid-bass woofer or mid driver 3. Left enclosure 41*a* would be mirrored for the right surround and right surround back channels of a 7.1 system. The design by far reduces size, splits signals, could allow matrixing in other areas, could allow same signal somewhere else on multi-channel signal array.

Figure 6A:
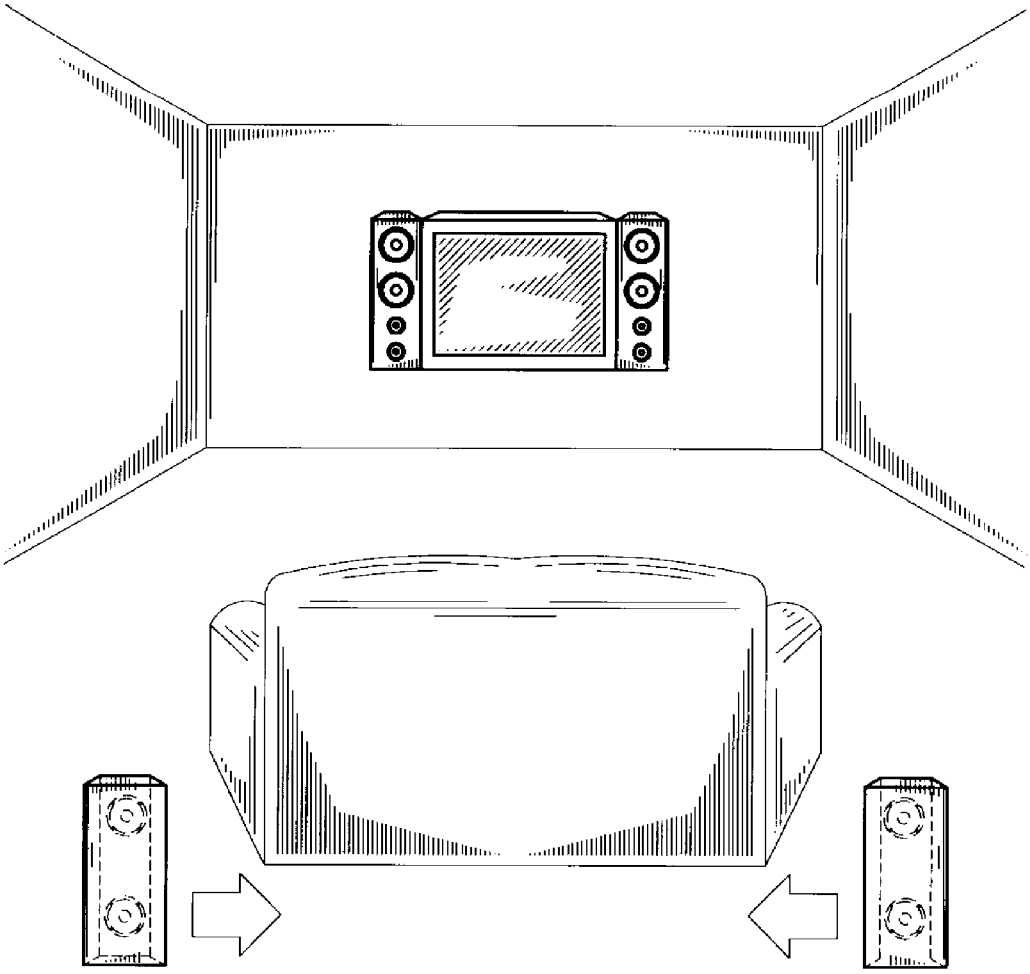
FIGS. 6*a*-6*c* illustrates various multi-channel/signal array sound systems employing the principals of the present invention.
Figure 6B:
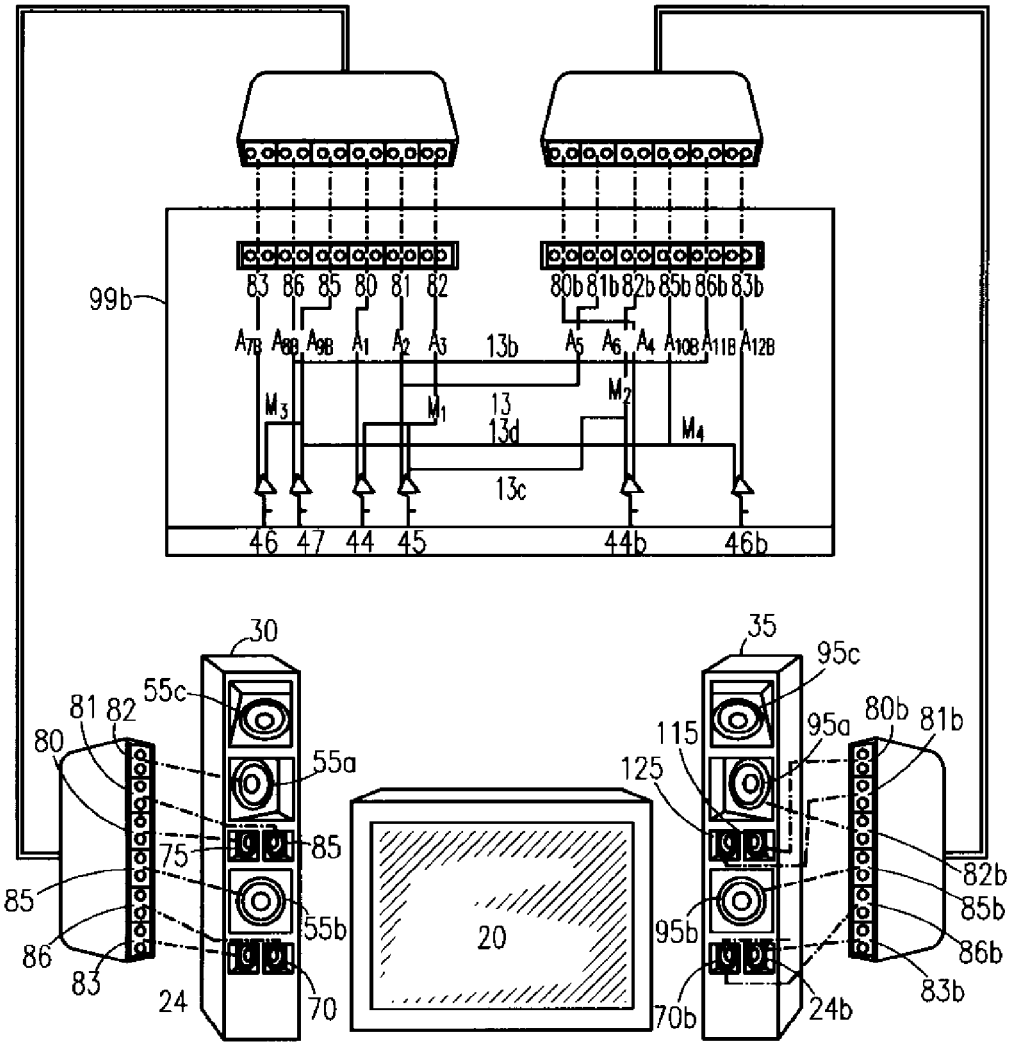

Referring now to FIGS. 6*a* and 6*a*1. Similar to FIG. 1*b*, multi-channel/signal cluster arrays left 30 and right 35, offer the same performance outcome as described for FIG. 1*b* with the same components for the front of the 6.1 system. Due to issues of cost, additions of other effects, etc., described herein is the same sound outcome via receiver or other amplification method, versus the use of dual or triple voice coils in the speakers.

In the back of FIG. 6*a* displayed differently than FIG. 1*b* are two rear multi-channel arrays versus the single array 40 shown in FIG. 1B for the 6.1 system. Due to the effect achieved, multiple external wires possibly required, and added cost, the rear effects are also described via receiver or other amplification method versus dual voice coils and internal speaker crossovers though dual voice coils and internal speaker crossovers can achieve the same sonic outcome. Please note: FIG. 1*a*-1C as described previously could also be achieved via receiver or other amplification method versus dual or triple voice coils with the same sound outcome and signal flow to the speaker components as described as with dual or triple voice coils and internal speaker crossovers.

While FIG. 1B generates the left rear, rear center and right rear channel effects at just one array 40, the two arrays shown in FIGS. 6*a* and 6*a*1 generate rear channel signals for all three of these channels at just left and right rear arrays 92 and 67.

As shown in FIG. 6*a* and in 6*a*1, discrete speaker components are utilized in multi-channel/signal arrays 67 and 92 in order to distribute the rear center effects into the rear center of the listening area. As shown higher more directional frequencies (225-20 kHz) are designated for discrete speaker components, though not to be limiting. Mid-high drivers 70 and 70*b* are mirrored in cluster 67 and 92. The drivers are aimed in at 30 degrees (though not limiting) to position the sound for the rear center channel into the rear center of the room. The effect achieved presents an illusion of the rear center channel. Mid-high driver 24 is designated to a discrete signal for the left rear channel at cluster 92. Mid-high driver 24*b* is designated to a discrete signal for the right rear channel at cluster 67. In order to reserve size, mid-bass frequencies generally 100-225 Hz (though not limiting) are designated to share multiple channel or signal mid-bass woofers. Mid-bass woofer 71 in the left cluster 92 is designated for the mid-bass of the left rear and rear center channels. Mid-bass woofer 71*b* in the right rear cluster is designated for the mid-bass of the right rear and the rear center channels.

Referring now to FIG. 6*a*1, a diagram depicting channel or signal flow associated with FIG. 6*a* is shown. Drivers, woofers and tweeter combinations can vary which determine the exact frequencies the receiver or other amplification method is to channel mid-bass frequencies together to a mid-bass/midrange component and other frequencies to other components. Although shown using quick connect plugs, traditional speaker wire, wireless or other methods which can vary, can carry the signals in a similar fashion.

An Amplifier 99 would produce a series of outputs shown as positive and negative teeth for the easy plugs envisioned. Referring to the amplifier outputs for the left front cluster shown at 79 and front right cluster shown at 79*b*. 80 indicate positive and negative outputs for the higher frequencies of left front main channel 44. Amplified at A1, frequencies on average 225-20 kHz are channeled to left cluster 30 to the discrete left main mid-high frequency 2.5 driver with swivel tweeter 75 (not limiting to these higher frequencies based on design and designated components). A similar path for the front right main channel higher frequencies is shown at 44*b* amplified through A4 and channeled to right cluster 35 mid-high frequency driver 115 through outputs 80*b*.

Now referring to front center channel 45. As described previously cluster 30 and 35 generate front center channel sound at both clusters 30 and 35. Mid-high frequencies are mirrored at each side of the television and aimed in at 30 degrees. Left mid-high 2.5 swivel tweeter driver 85 and right mid-high drivers 125 receive and perform mid-high frequencies on average 225-20 kHz amplified A2 and amplified A5 shown bridged at 13. Although 2.5 drivers with swivel tweeters are used in this example other components could be used based upon design which designates a different frequency range for the discrete higher frequencies. Although shown for the front center channel other channels or future channels or signals could be specified.

Now referring to mid-bass woofers 55*a* in left cluster 30 and 95*b* in right cluster 35. As described previously 55*a* and 95*a* housed dual voice coils for two channel mid-bass performance for frequencies on average 100-225 Hz though not to be a limiting factor for frequencies based on design and components. This same sonic outcome can be achieved via amplification method versus dual voice coils (in other cases triple or more signals). Refer to receiver 99. Shown at 44 and 45, the mid-bass frequencies for the front left main channel (44), and the front center channel (45) are mixed at M1. The mid-bass of both the left front channel and the front center channel is amplified at A3 and channeled to woofer 55*a* through output 82. Shown at 44*b* and 45, the mid-bass frequencies for the right main channel 44*b* and the front center channel are mixed at M2. Like bridge 13 for the higher center channel frequencies, bridge 13*c* designates front center channel mid-bass frequencies for use at both left cluster 30 and right cluster 35. The mid-bass combination of the right front channel and the front center channel is amplified at A6 and channeled to woofer 95*a* through output 82*b*. Decoding at the amplifier level versus dual or multiple voice coils is less costly with the same outcome as dual or triple voice coils. PLEASE NOTE in this case 55*b* and 95*b* are shown passive radiators (ports) or they can be in parallel or series with 55*a* and 95*a* for dual active woofer performance or nonexistent.

Now referring to outputs 79*c* and 79*d* for the left surround cluster 92 and right surround clusters 67. As in front duster arrays 30 and 35 with 55*a* and 95*a*, the mid-bass woofer 71 of left surround 92 and the mid-bass woofer 71*b* on right surround 67 combine mid-bass for the rear center channel with the mid-bass for the left and right surround channels.

Additionally like shown in left cluster 30 and 35 with left and right drivers 85 and 125 for the front center channel, Swivel tweeter 2.5 mid-high driver 70 in the left surround cluster 92 and swivel tweeter 2.5" mid-high driver 70*b* in the right cluster 67 are positioned directing higher more directional frequencies on average of 225-20 kHz into the rear center of the room creating the illusion of a rear center. Like in front cluster 30 and 35, mid-high drivers 70 and 70*b* are mirrored at 30 degrees into the center of the rear of the listening area (not to be limiting to frequencies or components and design).

Shown at 46, the left surround channel, and 46*b*, the right surround channel of receiver 99, the surround mid-high frequencies are followed through discretely for left and right surrounds by amplifier A7 and A12. The signals are channeled through left rear output 83 and right rear output 83*b* directed to mid-high left surround frequency driver 24 and right mid-high frequency driver 24*b* of clusters 92 and 67. The mid-high frequencies for the rear center channel are indicated at 47 bridged at 13*b* and amplified at A8 and A11. The signals are then directed to mid-high driver 70 in left cluster 92 and mid-high driver 70*b* in right cluster 67 through outputs 86 and 86*b*.

Finally referring to the rear center, left rear and right rear channel mid-bass frequencies on average of 100-225 Hz though not to be limiting based upon design. Indicated at 47, the rear center mid-bass frequencies are bridged at 13*d* in order to send the signal to both left output 85 and output 85*b* for the left and right rear clusters. Amplified at A9 the left surround and rear center mid-bass combination are directed to output 85 for mid-bass combination performance in 92 at woofer 71. Likewise the rear center mid-bass frequencies are combined with the right rear channel signal mid-bass frequencies at M4. Amplified through A10 the signal is channeled through 85*b* and directed to mid-bass woofer 71*b* in cluster 67. Multiple channel or signal combinations of mid-bass frequencies can be done via amplification method via receiver or the like, wireless or through dual or triple voice coils. Via receiver level or the like can be less expensive than dual voice coils. On the other hand via receiver level can limit the consumer to a specific receiver or device without the option of choice for receiver.

For an understanding of how FIG. 1A would be achieved via amplification method versus internal speaker crossovers and dual or multiple voice coils 6*b* is depicted.

FIG. 6B utilizes the same components as FIG. 1A and offers the same performance outcome as FIG. 1A with the addition of two mid-high frequency drivers for left and right surround back channels (24 and 24*b*). It also illustrates two additional mid-high frequency drivers for the rear center channel not shown in FIG. 1A (drivers 70 and 70*b*). Additionally, FIG. 6*b* incorporates two extra mid-bass woofers one in left cluster 30 (55*c*), and another in cluster 35 (95*c*).

Mid-bass woofer 55*c* is paralleled to mid-bass woofer 55*a* inside the speaker for dual woofer mid-bass performance for the front center channel and the left main channel in cluster 30. Therefore, 55*c* will not be indicated via amplification method. 95*a* is paralleled to mid-bass woofer 95*c* inside the cluster 35 for dual mid-bass woofer performance for the front center channel and the right main channel therefore, 95*c* will not be indicated via amplification method.

Referring now to receiver 99*b* shown in FIG. 6*b*. In left multi-channel/signal array 30 speaker components, mid-bass woofer 55*a*, mid-high driver 85 and mid-high driver 75, receive and perform the same channeled path with the same outcome as described in FIG. 6*a*1 for the left front and front center channel of the system. Because of this for simplicity, we will describe only the rear 6.1 effects generated by cluster 30. In the right multi-channel/signal array 35 components, 95*a* mid-bass woofer, right front mid-high driver 115 and mirrored center mid-high driver 125 receive and perform the same channeled path with the same outcome as described in FIG. 6*a*1 for the right front channel and the front center channel. Because of this for simplicity, we will describe only the rear 6.1 effects generated by cluster 35.

Shown at left surround channel or signal 46, discrete mid-high frequencies of the left surround channel of the 6.1 system are channeled through amplifier A7*b* through outputs 83. The signal is then channeled to swivel tweeter mid-high 2.5" driver 24 for mid-high frequency output on average of 225-20 kHz of the left surround back channel though not to be a limiting factor of components and frequencies. Shown at right surround channel or signal 46*b*, discrete mid-high frequencies of the right surround channel of the 6.1 system are channeled through amplifier A12*b* to outputs 83*b*. The signal is then channeled to mid-high 2.5" driver 24*b* for mid-high frequency output on average of 225-20 kHz of the right surround back channel though not to be a limiting factor of components and frequencies.

Shown at rear center channel signal 47, the mid-high frequencies of the rear center channel are bridged at 13*b* and amplified at A8*b* and A11*b* for output to both left cluster 30 and right cluster 35. While output 86 channels the mid-high frequencies on average 225-20 kHz though not limiting, to left cluster driver 70, 86*b* channels mid-high frequencies to swivel tweeter 2.5" rear center channel driver 70*b* (though not limiting to components). Likewise the mid-bass frequencies for the rear center channel, on average of 100-225 Hz (though not to be limiting frequencies based on components) are bridged at 13*d* in order to achieve output to both the left cluster 30 and right cluster 35. Mixed at M3 the mid-bass combination of the left rear channel and the rear center channel are channeled to mid-bass woofer 55*b* in cluster 30 through outputs 85 (amplified at A9B). Mixed at M4 the mid-bass combination of the right rear channel and the rear center channel are channeled to mid-bass woofer 95*b* in cluster 35 through output 85*b* (amplified at A10B). Although FIGS. 1A and 6*a* reflect a design for 6.1 surround sound format, it should not be a limiting factor via, 5.1, 7.1 or future or other surround formats utilized by the art. While mid-bass woofers generate signals for more than one channel as described above thus should not be a limiting factor as discrete speaker components can be used in other designs based on other chosen speaker components for the preferred embodiment which is surround sound out of two multi-channel/multi-signal arrays. Multi-channel/signal arrays can generate discrete signals at more than one speaker component in the array, thereby they are not limited by delays and can perform discretely for more than one channel or signal of sound if desired.

Figure 6C:
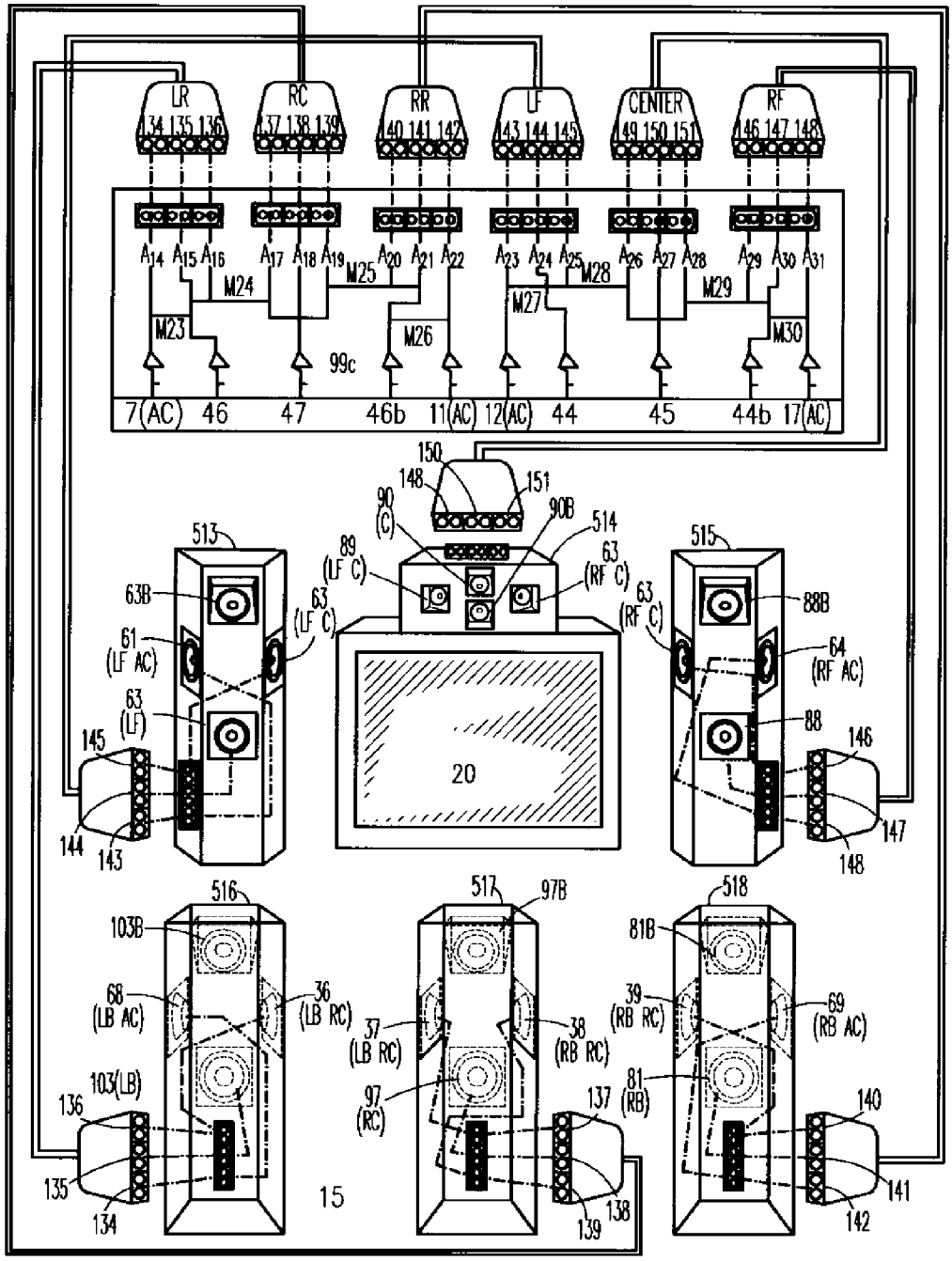

Referring next to FIG. 6C, as shown for a 6.1 speaker placement configuration format, FIG. 6C is depicted. FIG. 6C illustrates matrixed channels created in between multi-channel arrays as envisioned. Matrixed channel drivers are aimed in between the multi-channel arrays (generally at 30 degrees) to create additional channels and a wider soundstage throughout the listening area. Discrete on location channel sound can be generated simultaneously at each multi-channel/signal array through other designated speaker components.

While drivers are shown as full range drivers for simplicity, speaker components would vary based upon design and thus should not be a limiting factor. Drivers, tweeters and mid-bass woofers could be angled in all sorts of directions based upon designs. Typically mid-high drivers and tweeters and or tweeters alone, which generate more directional frequencies above 225 Hz, will be utilized for sound positioning and discrete channel signals. Mid-bass woofers would typically generate the mid-bass for more than one channel or signal as described previously in order to conserve size of the multi-channel arrays though this should not be limiting to the design.

While illustrated with easy plugs envisioned thus should not be a limiting factor to other conductivity methods such as conventional speaker wires, wireless or other means.

Referring to left front cluster 513 in FIG. 6C. Drivers 63 (LF) and 63*b* are designated to generating the standard left front channel of the 6.1 system. 44 on receiver 99*c*, channels the left main signal discretely to driver 63 (LF) through AMP A24 and plug terminals 144. In this case, driver 63 is paralleled to driver 63*b* inside the speaker, in other cases it could be crossed over when shown with mid-high frequency component(s).

Drivers 61 (LF AC) and 63 (LF C), are designated to generate matrixed channel signals. While driver 63 (LF C) generates the channel combination of the left main and the center channel mixed at M28 driven by AMP A25 through plugs 145 . . . driver 61 (LF AC) generates the left main channel and a future additional channel, shown at 12 (AC) mixed at M27, amplified at AMP A23 and channeled through terminals 143. In addition to creating extra channels in the system, angled typically at 30 degrees between clusters, the result is an illusion of another speaker channel outside of driver 61 (LF AC)) and 63 (LF C) and or in between clusters.

Referring next to center cluster 514. Drivers 90*c* and 90*b* are designated to generate the discrete channel signal of the center channel from 45 amplified through AMP A27 channeled through terminals 150. Drivers 90*c* and 90*b* are paralleled inside cluster 514 in this case, for dual driver output. 89 (LF C) and 63 (RFC) are designated to matrixed channel signals. Driver 89 (LF C) is designated to generate the matrixed combination of both the left main channel and the center channel. Mixed at M28 the signal is amplified at AMP A26 and channeled through plug terminals 149. Driver 63 (RF C) generates a matrixed sum of the right main channel and the center channel. Mixed at M29 the signal is amplified through AMP A28 and channeled through terminals 151.

Now referring to the right front multi-channel signal array 515. While driver 63 (RF C) generates the matrixed combination of the center and the right front channel signals through AMP A29, channeled through terminals 146, drivers 88 and 88*b* generate a discrete right main signal. 44*b* is amplified at AMP A30 and channeled through terminals 147 to driver 88. Next referring to driver 64 (RF AC), shown at 17 (AC). 17 (AC) displays a future additional channel of a 6.1 system mixed with the right front signal at M30 channeled through amp A31 and terminals 148 to driver 64 (RF AC). While these matrixed effects have been described for the front main, center, and left main existing channels of 5.1, 6.1 and 7.1 configurations, it is of preference to utilize some of these effects with these particular formats with the rear surround channels only, though not to be a limiting factor to the art.

Referring now to rear left multi-channel array 516. While drivers 103 (LB) and 103B generate discrete left back signals from 46 amplified at A15, drivers 68 (LB AC) and 36 (LB RC) are designated for matrixed channel reproduction. Driver 36 (LB RC) generates the matrixed combination of the left surround channel and the rear center channel. Driver 68 (LB AC) would perform for an additional channel matrixed with the left surround channel. Shown at M24, the rear center channel is mixed with the rear back surround channel amplified at A16 and channeled to 36 (LB RC) through terminals 136. Shown at 7 (AC), an additional channel is added to the current 6.1 format and mixed with the left surround channel at M23. The signal is channeled to driver 68 (LB AC) through terminals 134 amplified at A14.

Next referring to multi-channel/signal array 517. As done with the front center cluster, the rear center mufti-channel/signal array generates a discrete signal for the 6.1 rear center channel through drivers 97 (RC) and 97 *b* (shown amplified at A18 channeled through terminals 138). The rear center cluster also designates a full range driver 37 (LB RC), (full range driver shown for simplicity), for the matrixed combination of the left back surround channel and the rear center. Mixed at M24, the matrixed channel signal is amplified at A17 and channeled through terminals 137. The right back surround and the rear center matrixed channel signal is generated at driver 38 (RB RC) shown mixed at M25, amplified at A19 and channeled through terminals 139. The effect achieved by both 37 (LB RC) and 38 (RB RC) is two additional matrixed channels and a wider soundstage with the illusion of invisible speaker enclosures between multi-channel/signal arrays.

Finally referring to cluster 518. 81 (RB) and 81B are designated for discrete channel output for the right back channel of the 6.1 system. Shown at 46*b*, the right back channel signal is amplified at A21 and channeled through terminals 141. Driver 39 (RB RC) is designated to generate the matrixed channel signal of the right rear back channel and the rear center channel. Mixed at M 25 and amplified at A20 the signal is channeled to driver 39 (RB RC) through terminals 140. Driver 69 (RBAC) is designated for the matrixed combination of the rear right back channel and an additional added channel, Shown at 11(AC) the additional channel is mixed at M26 and amplified at A22 channeled through terminals 142.

Figure 6D:
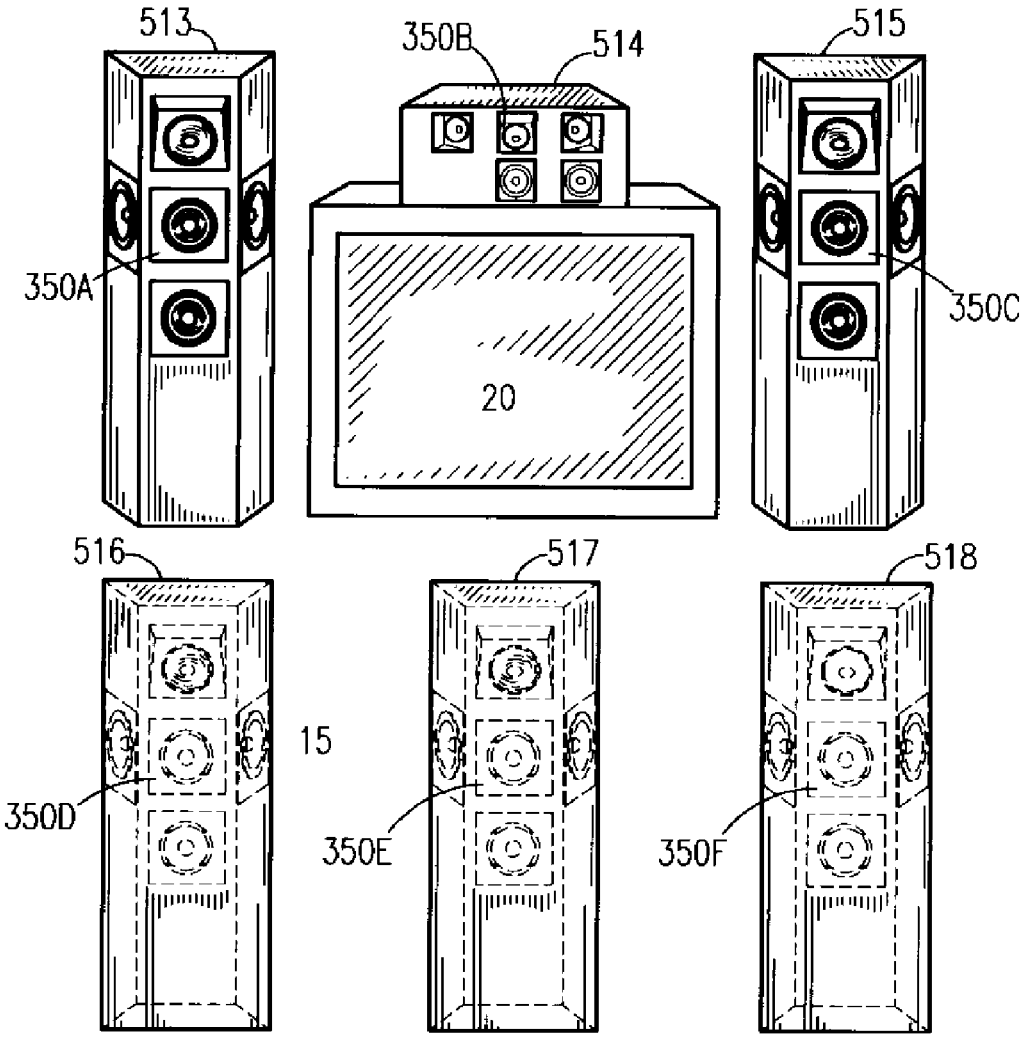
FIG. 6D is a continuation of 6*c* illustrating additional drivers 350*a*-350*f*
Figure 6E:
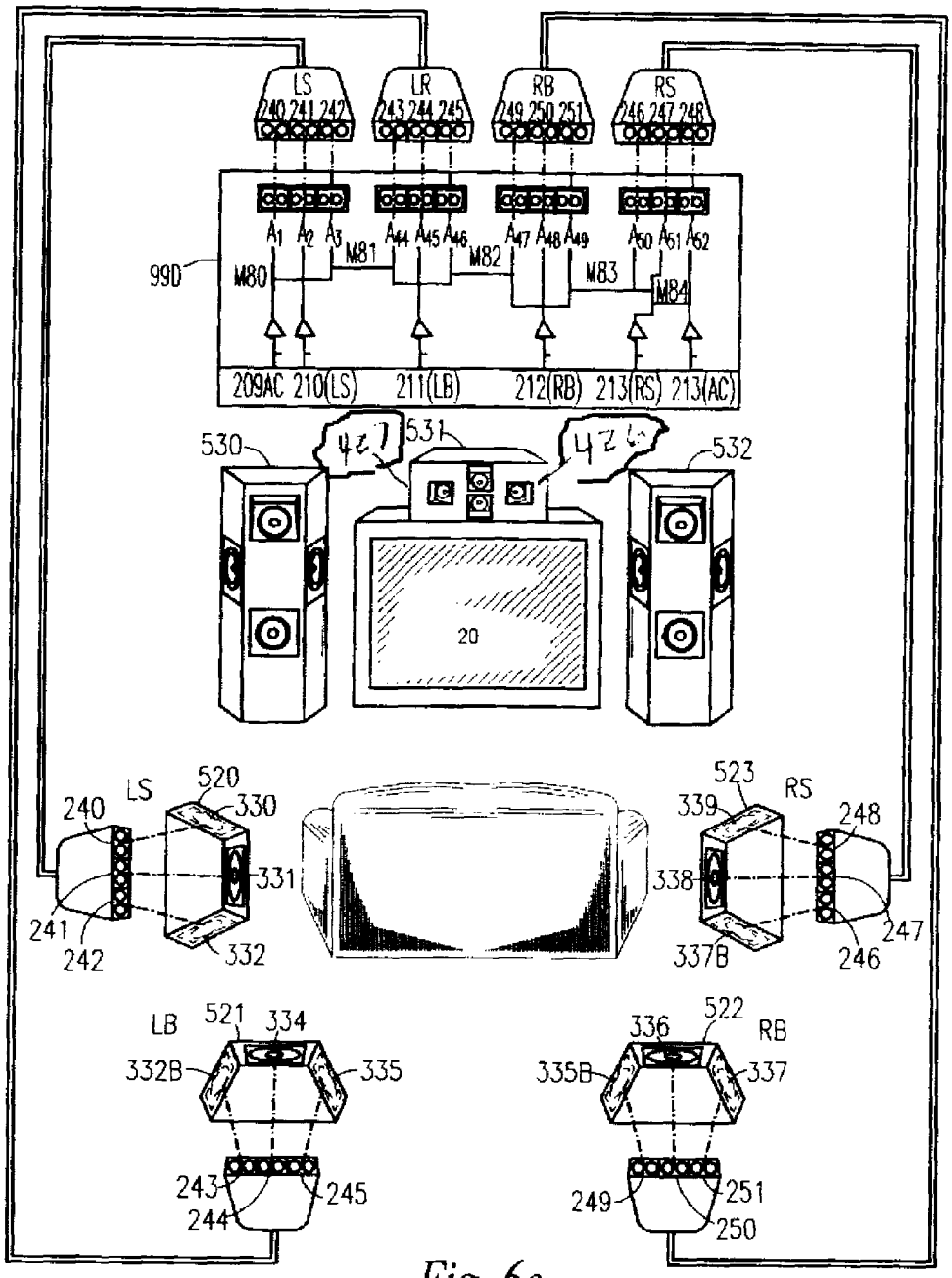
FIG. 6E is a 7.1 configuration showing matrixing between the rear multi-channel arrays from the arrays themselves in order to create additional channels or signals between the clusters.

Next referring to FIGS. 6*d* and 6E, FIG. 6*d* is a continuation of FIG. 6*c* illustrated with an additional driver at each multi-channel/signal array (350*a*-350*f*). The additional drivers shown at each cluster in FIG. 6*d* are displayed for additional channels, additional effects and or, matrixing between discrete or nondiscrete channels in the speaker cluster itself. Future channels or signals claiming to generate effects are possible with multi-channel/multi-signal arrays and are envisioned. Future channels and or effects could require additional speaker components.

Referring now to FIG. 6E, 6E illustrates matrixed channels in between the rear surround channels of the current state of the art 7.1 speaker placement configuration by designating speaker components among multi-channel arrays for these effects. While configuration 6E is illustrated with full range drivers for simplicity, thus should not be a limiting factor to the speaker components utilized to generate these effects. In many cases mid-bass woofers would be utilized to generate more than one channel or signal of sound while higher more directional frequencies would be generated by mid-high drivers and or tweeters performing on average though not to be limiting, above 225 kHz.

While 6E is illustrated with preferred easy plugs thus should not be a limiting factor to wireless, conventional speaker wire methods or other methods. 7.1 configurations require 7 speakers throughout the listening area along with a subwoofer for low bass frequencies below 100 Hz if the subwoofer is not located inside a speaker (100 Hz is the standard cut-off point for subwoofers on Dolby receivers where signals are sent to the subwoofer).

For simplicity and due to preference, though not to be limiting to placement of the matrixing effects described among multi-channel/signal arrays, cluster 530, and 532 will be refereed to as standard one channel speakers performing for the front left channel, and front right channel.

Therefore multi-channel/signal arrays will be illustrated only in the back of the room and the front center channel.

Due to design, of the front center multi-channel array in configuration 6*e* the crossover networks will be described as inside the multi-channel array, while via receiver unit in the back of the room. Referring to multi-channel array 531, driver (shown full range for simplicity) 426 employs a triple voice coil in order to perform in this case for the front left, right and center channel. Simultaneously multi-channel array 530 performs for the left front channel and multi-channel array 532 performs for the right front channel. Because multi-channel array 531 performs for the left and right main channels simultaneously with 530 and 532, the result again is a wider soundstage and also in this case superior imaging. In order to reserve in size of multi-channel array 531, driver 426 is illustrated as a triple voice coil driver/mid-woofer. One coil receives and parallels the center channel signal to driver/mid-woofer 427. Another coil of 426 receives and parallels the left front signal to 427. The last coil of 426 receives and parallels the right front main signal to 427 although this should not be limiting to speaker component or design preference for this multi-channel array configuration in the front of the room displayed (the 2 remaining drivers are illustrated as passive radiators, which could be replaced by ports or nonexistent. Additionally, in most cases, frequently signals would be crossed over to higher frequency drivers and or tweeters. While illustration FIG. 6*e* displays multi-channel arrays in the back of the listening area, the rear effects of the configuration could be generated at multi-channel arrays in the front of the listening area such as array 530, 531 and 532 along with clusters in the rear of the listening area or instead of multi-channel arrays in the back of the listening area. With the conventional surround sound formats available today in the front of the listening area, configurations 6*c*-6*e* offer superior imaging with a lifelike soundstage by designating a center multi-channel array to perform for the left and right main channels while other conventional speakers, or multi-channel arrays outside the array perform simultaneously for the left and right main channels. Even more beneficial would be the addition of future channels or effects available through multi-channel arrays.

Referring now to multi-channel rear left side array (331). As 520 is placed at the standard placement for 7.1 left surround. It not only performs discretely for the left surround channel it also utilizes drivers 330 and 332 in order to generate additional channel matrixed effects. Shown at 210 (LS) on receiver 99*d*, the left surround signal is channeled discretely to full range driver 331 (not limiting to components) through terminals 241 amplified at AMP A42 thus placing the on location sound for the left surround speaker as recommended in the room for 7.1. Referring next to driver 332. Driver 332 is utilized to generate a matrixed signal of the left surround and the left back channels. The result is an additional channel, a wider soundstage and the illusion of another speaker enclosure between multi-channel/signal arrays. Shown at M81, the left surround channel signal is mixed with the left surround back channel and amplified at AMP A43. The signal is then channeled to driver 332 through plug terminals 242. Next referring to driver 330. Driver 330 is designated for a possible additional channel to the 7.1 system shown at 209 (AC). 209 (AC) on receiver 99*d*, is shown mixed with the left surround channel signal at M80, amplified at AMP A41 and channeled to driver 330 through plug terminals 240.

Placed at left back of the 7.1 configuration, multi-channel/signal array 521 is appropriately placed for a 7.1 configuration. Driver 334 to is utilized discretely in order to generate a discrete signal for the left back surround channel signal shown at 211 (LB) on receiver 99*d*. 211 (LB) signal is amplified at AMP A45 and channeled to driver 334 through plug terminals 244. Driver 332*b* is designated to perform for a matrixed sum of the left surround back and the left surround channel signals in a 7.1 system (not to be limiting to 7.1 configurations). Any or all frequencies could be matrixed. The signal channeled to 332*b* is mixed at M81 and channeled to driver 332*b* through plug terminals 243. Similar to 332*b*, 335 is designated for a matrixed signal of the left back and right back channels of the 7.1 system. Best angled at 30 degrees, 335 again, generates an additional channel, wider soundstage and the illusion of another speaker enclosure between cluster 521 and 522. Shown at M82, the left back channel signal is mixed with the right back channel signal of the system. Amplified at AMP A46, the signal is channeled to driver 335 through terminals 245.

Referring now to multi-channel/signal array 522 placed at right surround back of the 7.1 system. Driver 336 performs discretely for the right back 7.1 channel. Shown at 212 (RB) the channel signal is amplified at AMP A48 and channeled to driver 336 through plug terminals 250. Driver 335*b* is designated to the matrixed signal of the left back and the right back surround channels. Mixed at M82 the channel signal is amplified at AMP A47 and channeled through terminals 249. Next Referring to driver 337. Driver 337 is designated to generate a matrixed channel signal of the right back and the right surround channels. Shown mixed at M83 the channel signal is amplified at AMP A49 and channeled to driver 337 through terminals 251

Finally, referring to multi-channel/signal array 523. Driver 338 is designated for the discrete channel signal of the right surround channel of the 7.1 system. Shown at 213 (RS), the right surround channel is amplified at AMP A51 and channeled to driver 338 through plug terminals 247. Like driver 337 in multi-channel/signal array 522, driver 337*b* is designate for a matrixed channel signal of the right back and right surround channels of the 7.1 system. Mixed at M83 and amplified through AMP A50, the signal is channeled to driver 337*b* through plug terminals 246. Next referring to driver 339. Driver 339 is designated for an additional future channel shown at 213 (AC) on receiver 99*d*. The channel signal is shown matrixed with the right surround channel at M84. Amplified at AMP A52 the matrixed channel signal is directed to driver 339 through terminals 248.

Future channels or signals claiming to generate effects are possible with multi-channel/multi-signal arrays and are envisioned. Future channels and or effects could require or allow additional speaker components.

2. Operation of the Preferred Embodiment

The preferred embodiment of the present invention can be utilized by the common user in a simple and effortless manner with little or no training once installed and operational, it is transparent to the typical listener when compared to a conventional 6.1 surround sound system. After acquisition of the multi-channel/signal array 10 shown in FIG. 1*a*, comprised primarily of the left front cluster array 30, the right front cluster array 35, the two separate speaker clusters would be arranged in a home theater room 15 following the general arrangement as shown in FIG. 1*a*. Subwoofer 45 may alternately be provided inside and along a bottom of left front speaker cluster 30 or the right front cluster array 35, in lieu of independent positioning illustrated in FIGS. 1*a* and 1*b*. Next, the left front cluster array 30 and the right front cluster array 35, must be connected to a suitable surround sound source, such as a surround sound amplifier, receiver or the like adapted for receiving signals and transmitting such signals to cluster arrays 30, 35 for producing sound therefrom via a method which includes but is not limited to wireless units, internal amplifiers housed within left front cluster array 30, and the right front cluster array 35, and current industry standard signal transceiver methods and obvious variants and modifications which allow the present invention's principles to apply to unpublished current signal transceiver methods and future industry standards so as to be considered within invention's scope. With respect to traditional receiver units, the left front signal would be received and delivered by the left front cluster array 30, the right front signal would be received and delivered by the right front cluster array 35, the center front signal be received and delivered to both the left front cluster array 30 and the right front cluster array 35, the rear center signal, delivered by cluster arrays 30,35, left rear signal is delivered by cluster array 30, and right rear signal is delivered by cluster array 35.

For use with rear array 40, as shown in FIG. 1*b*, the rear center, rear right and rear left signal would be received and delivered by the rear multi-channel/signal array 40, the rear right and left signals would be received and delivered by the rear multi-channel/signal array 40, the rear center signal would be received and delivered by the rear speaker cluster 40, as opposed to cluster arrays 30 and 35 for the rear channels, and the sub-woofer signal, if used, would be connected to the subwoofer 45. Subwoofer 45 may alternatively be provided and suitably connected inside and along a bottom of left front cluster array 30, the right front cluster array 35, and/or the rear multi-channel/signal arrays 40. Finally, a suitable program source, such as a conventional DVD encoded with a surround sound audio program would be played. The listener(s) would sit at a location near or at the listening position 25 to gain the maximum audio effect.

The foregoing description of specific embodiment's of the present invention have been presented for purposes of illustration and description. They are not intended to be exhaustive or to limit the invention to the precise forms disclosed, and obviously many modifications and variations are possible in light of the above teachings. The embodiments were chosen and described in order to best explain the principals of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. A multi-channel/signal array comprising:

a left front cluster array positioned left of a television monitor;

a right front cluster array positioned right of the television monitor;

a subwoofer;

a rear cluster array;

said left front cluster array and said right front cluster array are provided with at least two discrete audio signals via a receiver unit, wherein said receiver unit is adapted to receive said at least two discrete audio signals having been generated via said receiver unit to said left front cluster array, to said right front cluster array and to said subwoofer;

said rear cluster array provided with at least two discrete audio signals via a receiver unit, wherein said receiver unit is adapted to receive and transmit said at least two discrete audio signals having been generated via said receiver unit to said rear cluster array and a signal to said subwoofer;

connection mechanism adapted to connect said left front cluster array, said right front cluster array, said rear cluster array and said subwoofer to said receiver unit;

a subwoofer signal is transmitted and accepted by said subwoofer;

a front center signal, a left main signal, and a left rear signal are transmitted and accepted by said left front cluster array thereby providing sound adapted to produce sound which appears to emanate from locations other than the sound's source;

a front center signal, a right main signal, and a right rear signal are transmitted and accepted by said right front cluster array thereby providing sound adapted to produce sound which appears to emanate from locations other than the sound's source; and a right rear signal, a left rear signal and a center rear signal are transmitted and accepted by said rear cluster array, thereby proving sound adapted to produce sound which appears to emanate from locations other than the sound's source.

2. The multi-channel/signal array of claim 1, wherein said left front cluster array comprises a left cluster enclosure for housing:

a first mid-bass woofer, said first mid-bass woofer utilizes a multiple voice coil for multiple channel mid-bass reproduction;

a second mid-bass woofer, said second mid-bass woofer utilizing a multiple voice coil for multiple channel mid-bass reproduction;

a first mid-high driver, said first mid-high driver utilizes a multiple voice coil; and a second mid-high driver, said second mid-high driver utilizes a multiple voice coil.

3. The multi-channel/signal array of claim 2, wherein said right front cluster array comprises a right cluster enclosure for housing:

a third mid-bass woofer, said third mid-bass woofer utilizes a multiple voice coil for multiple channel mid-bass reproduction;

a fourth mid-bass woofer, said fourth mid-bass woofer utilizing a multiple voice coil for multiple channel mid-bass reproduction;

a third mid-high driver; said third mid-high driver utilizes a multiple voice coil; and a fourth mid-high driver, said fourth mid-high driver utilizes a multiple voice coil.

4. The multi-channel/signal array of claim 1, wherein said rear cluster array comprises a rear cluster enclosure for housing a plurality of separate sound signal producing devices in the mid-high driver range.

5. The multi-channel/signal array of claim 4, wherein at least one said sound producing device is forwardly positioned to direct sound directly at a listening position.

6. The multi-channel/signal array of claim 4, wherein said Plurality of sound producing devices are angularly positioned or located at other positions on the multi-channel/signal array.

7. The multi-channel/signal array of claim 4, wherein said plurality of sound producing devices are side-firing positioned, thus directing sound waves to opposite walls to produce a sound effect for each signal or channel which appears to emanate from opposite sides of a home theater room.

8. The multi-channel/signal array of claim 4, wherein said plurality of sound producing devices each utilize a multiple voice coil.

9. The multi-channel/signal array of claim 3, wherein said fourth mid-high driver and said second mid-high driver are capable of being angled towards the television monitor for positioning sound between said left front cluster array and said right front cluster array.

10. The multi-channel/signal array of claim 9, wherein said fourth mid-high driver and said second mid-high driver are angled at thirty degrees towards the television monitor.

11. The multi-channel/signal array of claim 2, wherein:

said first and said second mid-bass woofers are further amplified; and said first and second mid-high drivers are amplified.

12. The multi-channel/signal array of claim 1, wherein said left front cluster array comprises a left cluster enclosure for housing:

a first mid-bass woofer, said first mid-bass woofer utilizes a multiple voice coil for multiple channel mid-bass reproduction;

a first mid-high driver, said first mid-high driver utilizes a multiple voice coil; and a passive radiator.

13. The multi-channel/signal array of claim 12, wherein:

said first mid-high driver performs discretely; and said second mid-high driver performs discretely.

14. The multi-channel/signal array of claim 8, wherein said plurality of sound producing devices are amplified.

15. The multi-channel/signal array of claim 3, wherein said left cluster enclosure and said right cluster enclosure are each further adapted to accommodate more than one channel and wherein:

said first mid-high driver and said third mid-high driver are each fed an identical signal; and said second mid-high driver and said fourth mid-high driver are each fed an identical signal;

whereby a center channel speaker sound emulating a front center channel is created that appears to be coming from the center relative to the television monitor.

16. The multi-channel/signal array of claim 1, wherein said connection mechanism is a wireless communication mechanism.

17. A multi-channel/signal array comprising:

a left front cluster array positioned left of a television monitor;

a right front cluster array positioned right of the television monitor;

a subwoofer;

a left rear cluster array;

a right rear cluster array;

said left front cluster array and said right front cluster array are provided with at least two discrete audio signals via a receiver unit, wherein said receiver unit is adapted to receive and transmit said at least two discrete audio signals having been generated via said receiver unit to said left front cluster array, to said right front cluster array and a signal to said subwoofer;

said left rear cluster array and said right rear cluster array are provided with at least two discrete audio signals via said receiver unit, wherein said receiver unit is adapted to receive and transmit said at least two discrete audio signals having been generated via said receiver unit to said left rear cluster array, to said right rear array and a signal to said subwoofer;

connection mechanism adapted to connect said left front cluster array, said right front cluster array, said left rear cluster array, said right rear cluster array and said subwoofer to said receiver unit;

a subwoofer signal is transmitted from said receiver and accepted by said subwoofer;

a front center signal, a left main signal, and a left rear signal are transmitted and accepted by said left front cluster array thereby providing sound which appears to emanate from locations other than the left front cluster array;

said front center signal, a right main signal, and a right rear signal are transmitted and accepted by said right rear cluster array, thereby providing sound which appears to emanate from locations other than the right rear cluster array;

a front center signal, a right main signal, and a right rear signal are transmitted and accepted by said right front cluster array, thereby providing sound which appears to emanate from locations other than the right front cluster array; and said front signal, a left rear signal, a right main signal and said center rear signal is transmitted and accepted by said left rear cluster array, thereby proving sound which appears to emanate from locations other than the sound's source.

18. The multi-channel/signal array of claim 17, wherein said connection mechanism further comprises a wireless communication mechanism.

19. The multi-channel/signal array of claim 17, wherein said left front cluster array comprises a left cluster enclosure for housing:

a first mid-bass woofer, said first mid-bass woofer utilizes a multiple voice coil;

a second mid-bass woofer, said second mid-bass woofer utilizing a multiple voice coil for multiple channel mid-bass reproduction;

a first mid-high driver, said first mid-high driver utilizes a multiple voice coil; and a second mid-high driver, said second mid-high driver utilizes a multiple voice coil.

20. The multi-channel/signal array of claim 19, wherein said right front cluster array comprises a right cluster enclosure for housing:

a third mid-bass woofer, said third mid-bass woofer utilizes a multiple voice coil for multiple channel mid-bass reproduction;

a fourth mid-bass woofer, said fourth mid-bass woofer utilizing a multiple voice coil for multiple channel mid-bass reproduction;

a third mid-high driver; said third mid-high driver utilizes a multiple voice coil; and a fourth mid-high driver, said fourth mid-high driver utilizes a multiple voice coil.

21. The multi-channel/signal array of claim 17, wherein said left rear cluster array and said right rear cluster array each comprises a rear cluster enclosure for housing a plurality of separate sound signal producing devices.

22. The multi-channel/signal array of claim 19, wherein said plurality of sound producing devices are forwardly positioned to direct sound directly at a listening position.

23. The multi-channel/signal array of claim 19, wherein said plurality of sound producing devices are angularly positioned relative to a listening position.

24. The multi-channel/signal array of claim 19, wherein said plurality of sound producing devices are side-firing positioned, thus directing sound waves to opposite walls to produce a sound effect for each signal or channel which appears to emanate from opposite sides of a home theater room.

25. The multi-channel/signal array of claim 19, wherein at least one of said plurality of sound producing devices each utilize a multiple voice coil.

26. The multi-channel/signal array of claim 19, wherein:

said first and said second mid-bass woofers are further amplified; and said first and second mid-high drivers are amplified.

27. The multi-channel/signal array of claim 19, wherein said left front cluster array comprises a left cluster enclosure for housing:

a first mid-bass woofer, said first mid-bass woofer utilizes a multiple voice coil for multiple channel mid-bass reproduction;

a first mid-high driver, said first mid-high driver utilizes a multiple voice coil; and a passive radiator.

28. The multi-channel/signal array of claim 17, wherein:

said first mid-high driver performs discretely; and said second mid-high driver performs discretely.

29. The multi-channel/signal array of claim 19, wherein said plurality of sound producing devices are amplified.

* * * * *